US006398352B1

(12) United States Patent
Morita

(10) Patent No.: US 6,398,352 B1
(45) Date of Patent: Jun. 4, 2002

(54) COVERING RUBBER MEMBER, PRINT HEAD, STORAGE BOX, AND INK JET PRINTING APPARATUS

(75) Inventor: Osamu Morita, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/640,379

(22) Filed: Aug. 17, 2000

(30) Foreign Application Priority Data

Aug. 24, 1999 (JP) ..... 11-236450

(51) Int. Cl.[7] ..... B41J 2/178
(52) U.S. Cl. ..... 347/86
(58) Field of Search ..... 347/85, 86, 87; 277/596, 607, 650, 630, 628

(56) References Cited

U.S. PATENT DOCUMENTS

| | | | | |
|---|---|---|---|---|
| 4,700,202 A | | 10/1987 | Kuranishi et al. | 347/86 |
| 5,500,663 A | * | 3/1996 | Ujita et al. | 347/86 |
| 5,751,322 A | | 5/1998 | Miller et al. | 347/86 |
| 5,780,116 A | * | 7/1998 | Sileo et al. | 427/456 |
| 5,781,213 A | | 7/1998 | Ujita et al. | 347/86 |
| 5,933,178 A | | 8/1999 | Solero | 347/85 |
| 6,039,441 A | * | 3/2000 | Tomikawa et al. | 347/86 |

FOREIGN PATENT DOCUMENTS

| | | |
|---|---|---|
| EP | 677389 | 10/1995 |
| EP | 829363 | 3/1998 |
| EP | 1 078 767 | * 2/2001 |
| JP | 10-318103 | * 12/1998 |

* cited by examiner

*Primary Examiner*—Michael P Nghiem
(74) *Attorney, Agent, or Firm*—Fitzpatrick, Cella, Harper & Scinto

(57) ABSTRACT

A seal rubber for use in print heads, ink jet printing apparatuses, that enables print heads to be appropriately manufactured while preventing the seal rubbers from sticking mutually, is provided. More specifically, a seal rubber provided in a joint section between a print head and an ink tank has a roughened surface for an appropriate surface roughness. Thus, even when a parts feeder is used to supply a large number of mixed seal rubbers during manufacture of print heads, the seal rubbers can be prevented from sticking mutually and can be properly separated for supply.

6 Claims, 31 Drawing Sheets

| NUMBER OF DAYS THAT TANKS ARE LEFT AS THEY ARE | 0 | 6 | 16 | 24 | 30 |
|---|---|---|---|---|---|
| Y1 | 0 | 0.2 | 0.45 | 0.7 | 0.9 |
| M1 | 0 | 0.14 | 0.31 | 0.49 | 0.63 |
| C1 | 0 | 0.2 | 0.51 | 0.72 | 0.81 |
| Bk1 | 0 | 0.18 | 0.42 | 0.63 | 0.81 |
| LM1 | 0 | 0.16 | 0.38 | 0.62 | 0.74 |
| LC1 | 0 | 0.17 | 0.47 | 0.7 | 0.83 |

| NUMBER OF DAYS THAT TANKS ARE LEFT AS THEY ARE | 0 | 10 | 14 | 18 | 32 |
|---|---|---|---|---|---|
| Y1 | 0 | 0.14 | 0.27 | 0.42 | 0.96 |
| M1 | 0 | 0.17 | 0.27 | 0.4 | 0.95 |
| C1 | 0 | 0.16 | 0.18 | 0.31 | 0.79 |
| Bk1 | 0 | 0.31 | 0.44 | 0.55 | 1.08 |
| LM1 | 0 | 0.27 | 0.37 | 0.48 | 0.94 |
| LC1 | 0 | 0.34 | 0.45 | 0.56 | 0.88 |

INK EVAPORATION RATE WITH INK TANK ON CARRIAGE AND LEFT AT 45°C (RELATIVE TO THE AMOUNT OF INJECTED INK) AND WITH STICKING MEASURES (SEAL RUBBER SURFACE ROUGHNESS: 12.5.μm)

| NUMBER OF DAYS THAT TANKS ARE LEFT AS THEY ARE | 0 | 6 | 30 | | |
|---|---|---|---|---|---|
| Y1 | 0 | 0.33 | 1.65 | | |
| M1 | 0 | 0.32 | 1.6 | | |
| C1 | 0 | 0.33 | 1.65 | | |
| Bk1 | 0 | 0.32 | 1.6 | | |
| LM1 | 0 | 0.31 | 1.55 | | |
| LC1 | 0 | 0.32 | 1.6 | | |

INK EVAPORATION RATE WITH INK TANK ON CARRIAGE AND LEFT AT 45℃ (RELATIVE TO THE AMOUNT OF INJECTED INK) AND WITH STICKING MEASURES (SEAL RUBBER SURFACE ROUGHNESS: 18.0μm)

| NUMBER OF DAYS THAT TANKS ARE LEFT AS THEY ARE | 0 | 13 | 20 | 30 | |
|---|---|---|---|---|---|
| Y1 | 0 | 0.9 | 1.35 | 2.01 | |
| M1 | 0 | 0.81 | 1.3 | 1.98 | |
| C1 | 0 | 0.85 | 1.39 | 2.06 | |
| Bk1 | 0 | 0.81 | 1.26 | 1.95 | |
| LM1 | 0 | 0.79 | 1.24 | 1.92 | |
| LC1 | 0 | 0.83 | 1.35 | 2.1 | |

INK EVAPORATION RATE WITH INK TANK ON CARRIAGE AND LEFT AT 45℃ (RELATIVE TO THE AMOUNT OF INJECTED INK) AND WITH STICKING MEASURES (SEAL RUBBER SURFACE ROUGHNESS: 25.0μm)

COVERING RUBBER MEMBER, PRINT HEAD, STORAGE BOX, AND INK JET PRINTING APPARATUS

BACKGROUND OF THE INVENTION

This application is based on Japanese Patent Application No. 11-236450 (1999) filed Aug. 24, 1999, the content of which is incorporated hereinto by reference.

1. Field of the Invention

The present invention relates to a print head for ejecting an ink for print, a storage box for the print head, and an ink jet printing apparatus, and in particular to a covering rubber member such as a seal rubber which is used particularly to prevent inks from evaporating.

The present invention is applicable to an apparatus such as a copy machine, a facsimile equipped with a communication system and a word processor having a print section as well as to an industrial printing apparatus combined with various processing apparatuses in a composite manner.

2. Description of the Related Art

Many ink-jet printing apparatuses that are used as printers or the like use an ink tank in a form of cartridge so that it can be easily replaced with another one. This ink tank system has advantages of allowing inks to be supplied easily, requiring relatively low running costs for print, and the like.

FIGS. 28A and 28B are perspective views showing an example of a configuration in which ink tanks are installed in a print head unit, and FIGS. 29A and 29B are transverse sectional views thereof. As shown in FIGS. 28B and 29B, while an ink tank 111 is installed in a print head unit 301, an ink supply port 211 of the ink tank 111 is connected to a joint section 204 of the print head unit 301 so that an ink is supplied to an interior of a print head 102 via the joint section 204. In this configuration, a seal rubber 207 is disposed around the joint section 204. so that while the ink tank 111 is installed in the print head unit, the ink supply port 211 of the ink tank 111 can come in contact with the joint section 204 while pressing the seal rubber 207. This connection system can prevent the ink from leaking or evaporating via this connection while the ink tank is installed.

The ink supplied to the print head 102 is guided through an ink fluid path 206 to a liquid path formed on a silicon substrate 201 and is then ejected by means of thermal energy generated by electro-thermal conversion elements (not shown) in the liquid path.

As described above, the ink jet printing apparatus generally use the seal rubber in a connection portion formed for an ink supply or the like, to particularly prevent the ink evaporation. The seal rubber for this application is reasonable in that it can establish airtightness of the connection portion between the ink tank and the print head with low costs to prevent the ink evaporation. The seal rubber for this application must be much deformed under a light load to have a high sealing capability. Thus, the seal rubber must be soft and has its hardness set at a relatively low value between 30 and 45 HS(A)(JIS: Japanese Industrial Standard).

Rubbers having such low hardness, however, may stick to each other upon contact. When print head units such as that shown in FIGS. 28A and 28B and FIGS. 29A and 29B are manufactured in a factory, automatic supply of the seal rubbers is performed by means of a parts feeder, for example. In such supply, the rubbers may stick mutually and cannot be supplied separately. Thus, an operation for separating the seal rubbers is required, thereby requiring a large amount of labor and time. It is contemplated that once the seal rubbers have been produced, they may be separately stored in individual trays, for example, so as not to contact mutually until an assembly process is started. This method, however, increases manufacturing costs.

As described above, in the case of handling the seal rubber in manufacturing the ink jet printing apparatus, the seal rubbers need to be appropriately prevented from sticking to each other.

The mutual sticking of the seal rubbers is significant particularly in an environment where atmosphere temperature is 20° C. or higher or humidity is 70% or more.

SUMMARY OF THE INVENTION

The object of the present invention is to provide a covering rubber member that enables print heads, ink jet printing apparatuses, or the like to be appropriately manufactured without creating a sticking problem of the covering rubber member, a print head using this covering rubber member, a storage box for the print head, and an ink jet printing apparatus.

In the first aspect of the present invention, there is provided a covering rubber member being in contact with and covering a predetermined member so as to seal the predetermined member enclosing an ink, wherein the covering member has a roughened surface.

In the second aspect of the present invention, there is provided a print head receiving a supply of an ink from an ink tank to eject the ink, the print head comprising:

a covering rubber member used for a connection portion for ink supply from the ink tank, the covering rubber member being in contact with and covering an ink supply port of the ink tank so as to seal the ink supply port enclosing the ink and the covering member having a roughened surface.

In the third aspect of the present invention, there is provided an ink jet printing apparatus using a print head and ejecting ink onto a printing medium to perform printing, wherein the print head including:

a covering rubber member used for a connection portion for ink supply from the ink tank, the covering rubber member being in contact with and covering an ink supply port of the ink tank so as to seal the ink supply port enclosing the ink and the covering rubber member having a roughened surface.

In the fourth aspect of the present invention, there is provided a storage box for storing a print head for ejecting an ink, the storage box comprising:

a cap rubber member being in contact with and covering a surface of a print head on which an ejection opening is disposed when the print head is installed in the storage box for storage, the cap rubber member having a roughened surface.

In the fifth aspect of the present invention, there is provided an ink jet printing apparatus using a print head and ejecting ink onto a printing medium to perform printing, the ink jet apparatus comprising:

a cap rubber member used for an ejection recovery operation for the print head, the cap rubber member being contact with and covering a surface of the print head on which an ink ejection opening is disposed and having a roughened surface.

With the above configuration, the covering rubber member and the cap rubber member have their surfaces subjected to the roughened finish ("roughened finish" means that a surface is roughened). As a result of this, when handling the covering rubber members or the like to manufacture the print head where these members are handled in a condition that they must be mutually contacted, the mutual sticking between them can be prevented due to the given surface roughness provided through the roughened finish. In particular, even if the rubber has a relatively low hardness to have more appropriate seal, the mutual sticking of the covering rubber members or the like can be prevented by appropriately setting the surface roughness.

The above and other objects, effects, features, and advantages of the present invention will become more apparent from the following description of embodiments thereof taken in conjunction with the accompanying drawings.

DETAILED DESCRIPTION OF THE PREFERRED EMBODIMENTS

Embodiments of the present invention will be described below in detail with reference to the drawings.

A printer will be explained below as an example of an ink jet printing apparatus using a seal rubber according to one embodiment of the present invention.

A term "printing", as used herein, refers to formation of images, patterns, or the like on a printing medium or processing of the printing medium whether meaningful information such as characters, graphics, or the like or meaningless information is to be formed or whether or not the information is embodied so as to be visually perceived by human beings.

A term "printing medium", as used herein, refers not only to paper for use in general printing apparatuses but also to materials such as cloths, plastic films, metal plates, glass, ceramics, woods, and leathers which can receive inks.

Furthermore, a term "ink" (or "liquid") should be broadly interpreted as in a definition of the above term "printing", and refers to a liquid that is applied to the printing medium to form images, patterns, or the like, process the printing medium, or process the ink (for example, solidify or insolubilize a coloring material in the ink applied to the printing medium).

1. Apparatus Body

Figure 1:
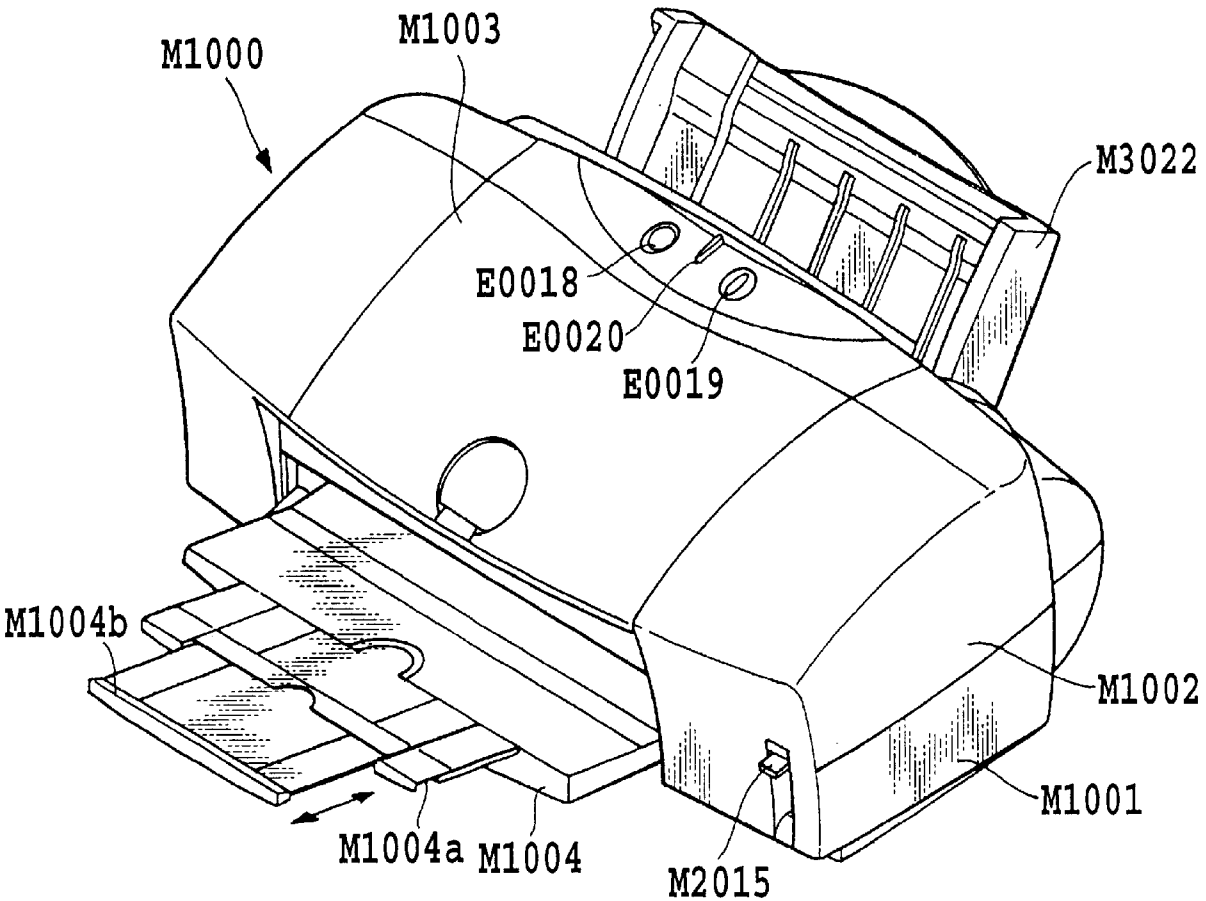
FIG. 1 is a perspective view showing an external construction of an ink jet printer as one embodiment of the present invention.
Figure 2:
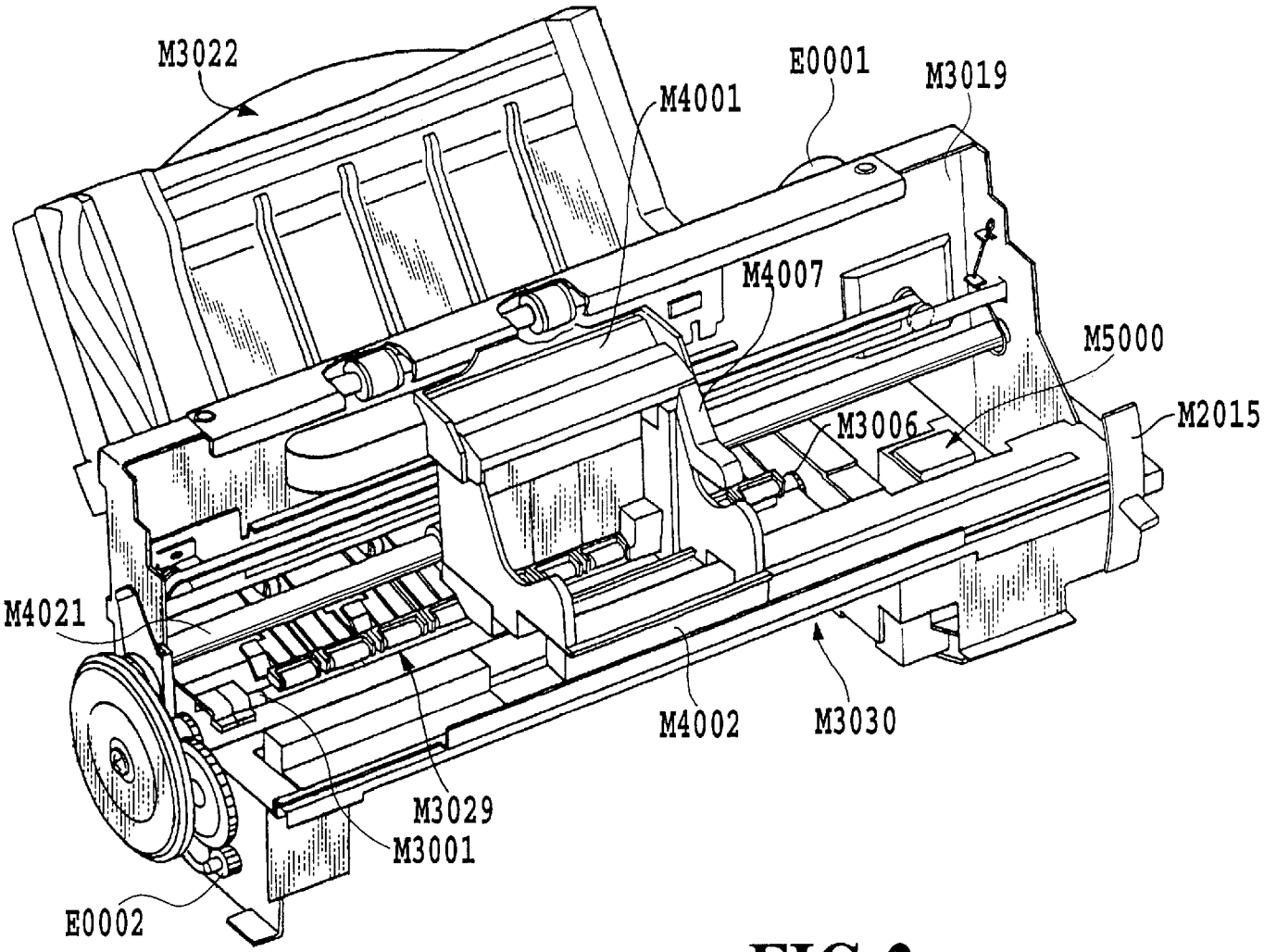
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1 Print Head Cartridge

First, the print head cartridge used in the print unit will be described with reference to FIGS. 3 to 5.

Figure 3:
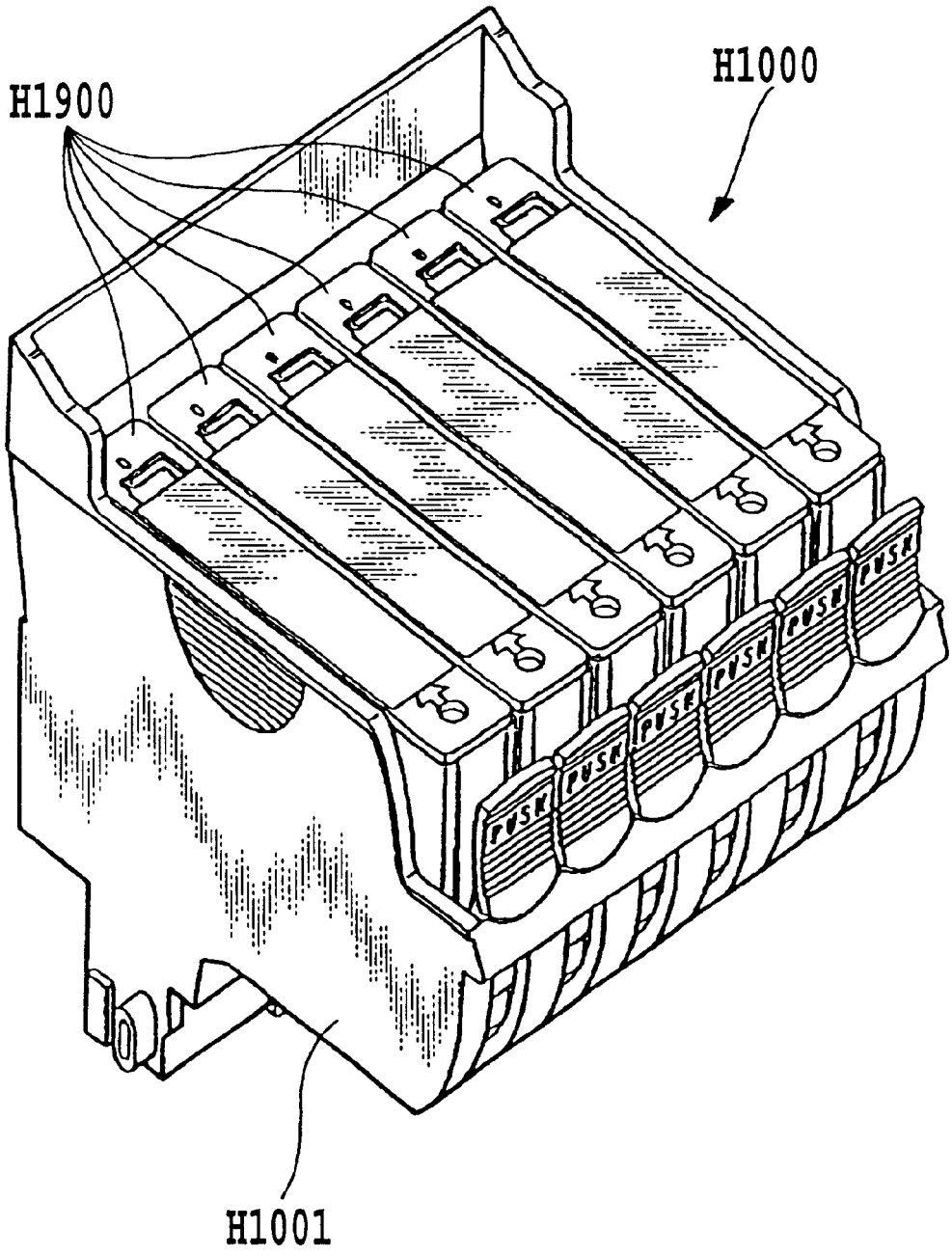
FIG. 3 is a perspective view showing an assembled print head cartridge used in the printer of one embodiment of the present invention.
Figure 4:
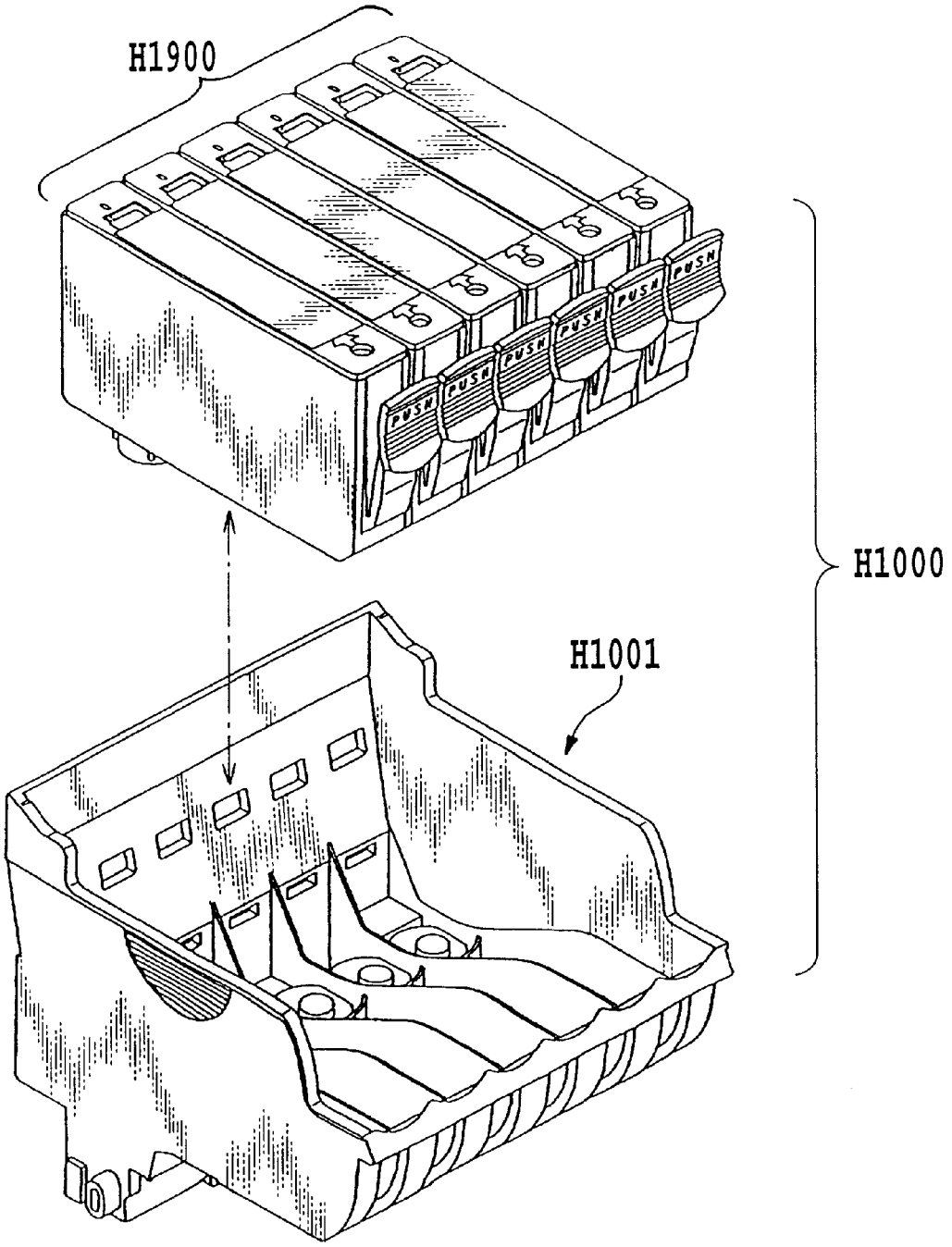
FIG. 4 is an exploded perspective view showing the print head cartridge of FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 11:
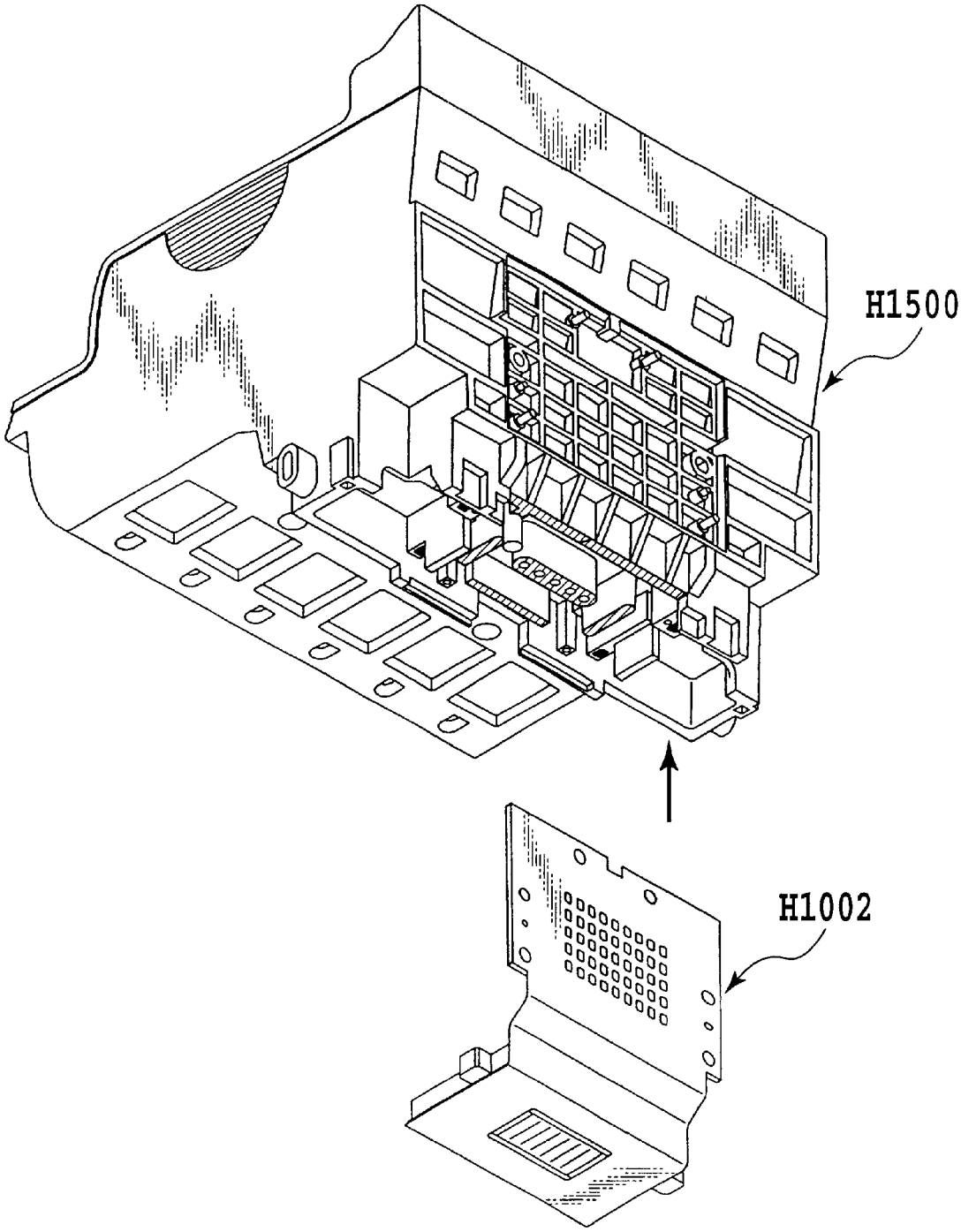
FIG. 11 is an exploded perspective view of the print head shown in FIG. 4.

Then, the print head H1001, as shown in FIG. 11, comprises a print element unit H1002 and a tank holder unit H1500. Further, the print element unit H1002, as shown in the exploded view of FIG. 5, includes a print element substrate H110, a first plate H1200, an electric wiring board H1300, a second plate H1400. The tank holder H1500 includes a flow passage forming member H1600, a filter H1700 and a seal rubber H1800 according to this embodiment.

The print element substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

Figure 12:
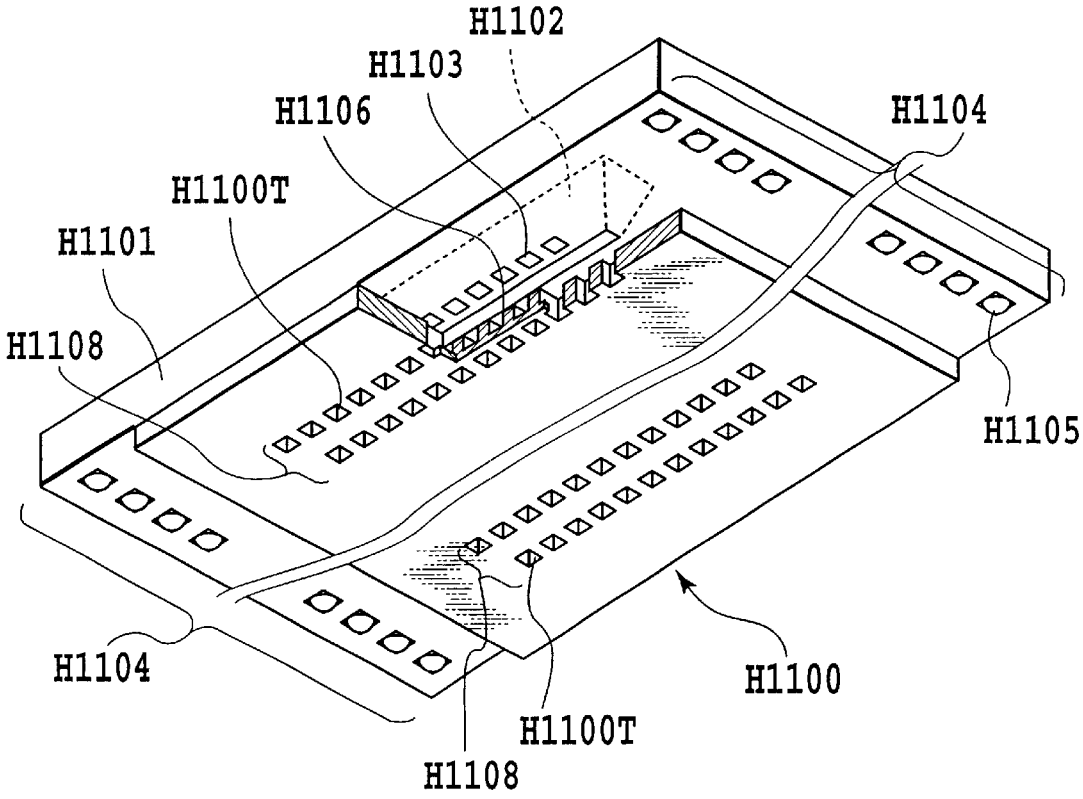
FIG. 12 is a partly broken perspective view of the print element substrate shown in FIG. 5.

FIG. 12 is a partly broken perspective view showing a detailed configuration of the print element substrate H1100.

The print element substrate H1100 comprises a silicon (Si) substrate H1101 of, for example, thickness 0.5 to 1 mm that forms a thin constituting member as a principal component. The substrate H1101 has six rows of ink supply ports H1102 (only one row is shown) each of which forms a slot-shaped through-hole acting as a path for supplying a corresponding one of six color inks. At each side of the respective ink supply ports H1102, row of electro-thermal conversion elements H1103 (the row of only the one side is shown) are arranged in a condition that the two rows of the elements of the both sides form a zigzag arrangement. The electro-thermal conversion elements H1103 and electric wiring of Al or the like for supplying power thereto are formed by means of a film formation technique. In addition, electrode sections H1104 for supplying power to the electric wiring have bumps H1105 of Au or the like.

The ink supply ports H1102 are formed by means of anisotropic etching utilizing a crystal orientation of the substrate H1101 of Si. If the Si substrate has a <100> crystal orientation on a wafer face and a <111> crystal orientation in its thickness direction, an alkaline (KOH, TMAH, hydrazine, or the like) anisotropic etching proceeds at an angle of about 54.7°. The desired depth of etching can be obtained using this method.

Furthermore, the Si substrate H1101 is provided thereon with ink path walls H1106 for forming ink paths as well as ejection openings H1100T correspondingly to the electro-thermal conversion elements H1103, both formed by means of the photolithographic technique, so that six rows H1108 of the ejection openings are formed in a fashion corresponding to the six color inks. Furthermore, the electro-thermal conversion elements H1103 is provided so as to face the ejection opening H1100T and generates heat to form a bubble in an ink supplied from the ink supply port H1102 so that the pressure of the bubbles causes the ink to be ejected from the ejection opening H1100T.

Next, the first plate H1200 described above will be described in detail with reference to FIG. 5 and other drawings again. The first plate H1200 is formed of an alumina (A1203) material of, for example, thickness between 0.5 and 10 mm. The material of the first plate is not limited to this alumina but may be any material that has a linear expansion coefficient equivalent to that of the material of the print element substrate H1100 and a thermal conductivity higher than or equivalent to that of the same. The material includes, for example, silicon (Si), aluminum nitride (AlN), zirconia, silicon nitride (Si3N4), silicon carbide (SiC), molybdenum (Mo), and tungsten (W).

The first plate H1200 is provided with six ink supply paths H1201 for respectively supplying the six inks to the print element substrate H1100. These six ink supply paths H1201 correspond to the six ink supply ports H1102 in the print element substrate H1100, and the print element substrate H1100 is bonded and fixed with high positional accuracy to the first plate H1200. A first adhesive used for bonding is coated on the first plate H1200 in substantially the same area as the shape of the print element substrate and is coated so as to create no air path between the adjacent ink supply paths. For example, the first adhesive desirably has a low viscosity, forms a thin adhesive layer on a contact surface, has a relatively high hardness after hardening, and resists the ink. Such an adhesive may be, for example, a thermosetting adhesive principally comprising an epoxy resin, in which case the adhesion layer desirably has a thickness of 50 $\mu$m or less.

Next, the electric wiring board H1300 will be described with reference to FIG. 5. The electric wiring board H1300 is provided for applying electric signals for ejecting the ink to the print element substrate H1100. The electric wiring board comprises an opening into which the print element substrate H1100 is fitted, electrode terminals (not shown) corresponding to the electrode sections H1104 (see FIG. 12) of the print element substrate H1100 and external-signal input terminals (not shown) located at wiring ends for receiving electric signals from the apparatus main body. In this manner, the electric wiring board H1300 and the print element substrate H1100 are electrically connected thereto. The connection can be performed by, for example, coating a thermosetting adhesive resin (not shown) between each electrode section H1104 of the print element substrate H1100 and the corresponding electrode terminal of the electric wiring board H1300 and by using a heat tool to simultaneously heat and press the electrode sections of the print element substrate H1100 and the corresponding electrode terminals of the electric wiring board H1300 to harden the thermosetting adhesive resin.

The thermosetting adhesive resin may comprise an anisotropic conductive adhesive containing conductive particles. With the configuration according to this embodiment, proper electric connections could be achieved when, for example, the electrode sections of the print element substrate H1100 and gold-plated electrode terminal sections of the electric wiring board H1300 were heated and crimped at temperature between 170° C. and 250° C. using an anisotropic conductive adhesive film comprising an adhesive mainly composed of nickel conductive particles of single particle size between 2 $\mu$m and 6 $\mu$m as well as an epoxy resin.

The material of the electric wiring board H1300 may be, for example, a flexible wiring substrate having a double-layered wiring in which a front layer is covered with a resist film. The external-signal input terminals of this wiring substrate have a reinforcing plate bonded to rear surfaces thereof to improve planarity thereof. The reinforcing plate may comprise a glass epoxy, aluminum, or another material, which is, for example, between 0.5 mm and 2 mm and which resists heat.

Furthermore, the second plate H1400 will be explained. The second plate H1400 is formed, for example, of alumina (A1203) material of thickness between 0.5 mm and 1 mm. The material of the second plate is not limited to alumina but may be any material that has a linear expansion coefficient equivalent to that of the print element substrate H1100 and first plate H1200 and a thermal conductivity higher than or equivalent to that of the same. The second plate H1400 is shaped to have an opening larger than the external dimensions of the print element substrate H1100 bonded and fixed to the first plate H1200. Furthermore, the second plate H1400 is bonded to the first plate H1200 with a second adhesive (not shown) so that the print element substrate H1100 and the electric wiring board H1300 are electrically connected together so as to be mutually flush. To a back surface of the electric wiring board H1300 a third adhesive (not shown) is used to bond. That is, the electric wiring board H1300 is bonded to the second plate H1400 while being simultaneously folded at the same one side of the first plate H1200 and second plate H1400 and bonded to the side of the first plate H1200 with the third adhesive. For example, the second adhesive may have a small viscosity, forms a thin adhesive layer on a contact surface, and resists the ink. In addition, the third adhesive may be, for example, a thermosetting adhesive film mainly comprising an epoxy resin and having a thickness between 10 $\mu$m and 100 $\mu$m.

In the print element unit H1002 configured as described above, the electric connections between the print element substrate H1100 and the electric wiring board H1300 are sealed with a first sealant (not shown) and a second sealant so as to be protected from corrosion caused by the ink or external impacts. The first sealant principally seals outer peripheral portions of the print element substrate H1100, whereas the second sealant seals mainly seals edges of the opening in the electric wiring board H1300. In addition, the folded electric wiring board H1300 is further formed depending on the shape of the tank holder H1500.

To the tank holder H1500 that removably holds the ink tank H1900 in the print element unit described above, as shown in FIG. 5, the flow passage forming member H1600 is securely attached, by means of ultrasonic fusing, for example, to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800 according to the embodiment, and the print element unit, which includes the print element substrate H1100, the first plate H1200, the electric wiring board H1300 and the second plate H1400, are combined as by adhesives to form the print head H1001.

The tank holder H1500 will be described further in detail. The tank holder H1500 is formed, for example, by molding a resin. This resin material desirably contains 5% to 40% of glass fillers to improve geometrical rigidity.

Figure 5:
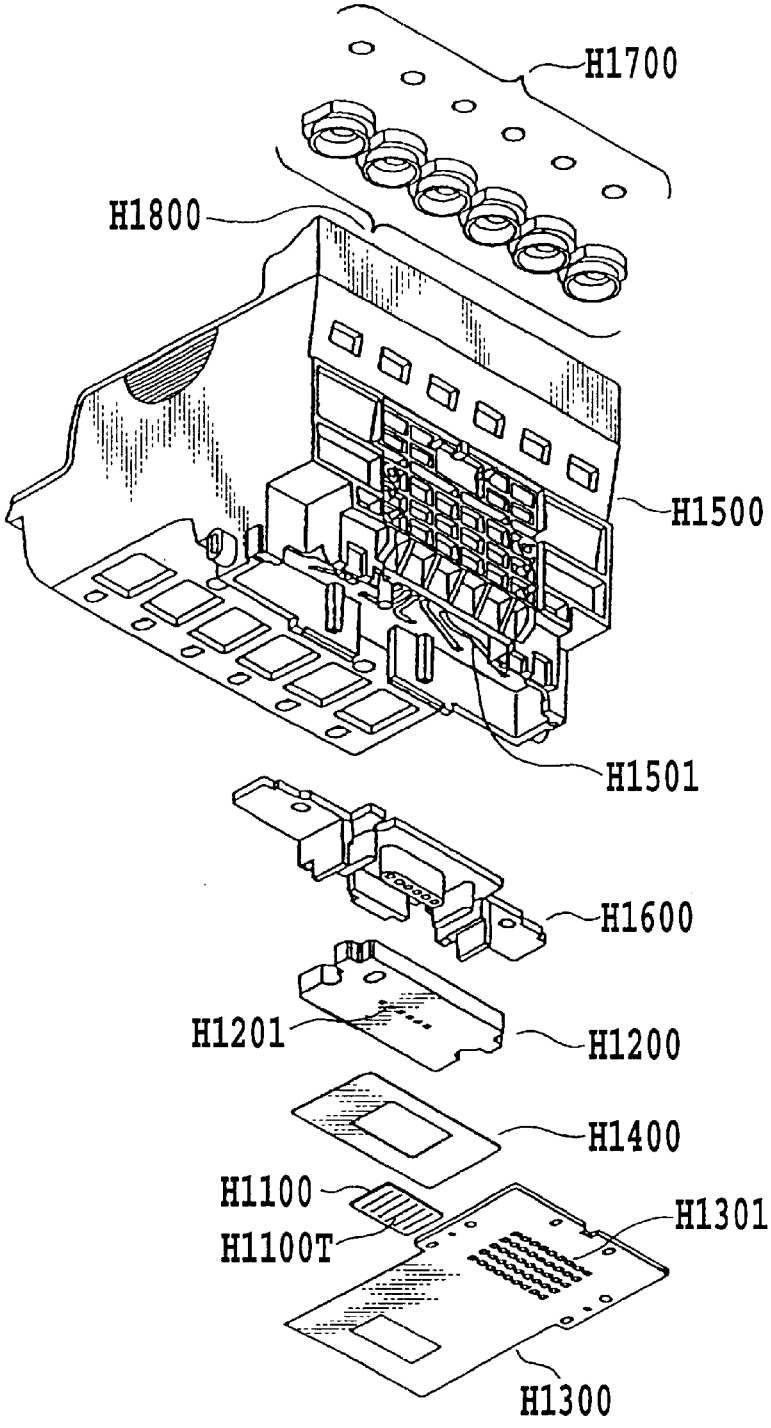
FIG. 5 is an exploded perspective view of the print head of FIG. 4 as seen diagonally below.

The tank holder H1500 holds removable ink tanks H1900 as described above and comprises tank positioning holes, a first hole (not shown), a second hole (not shown), and a third hole that engage with tank positioning pins, a first pawl, a second pawl, and a third pawl, respectively, which are provided on the ink tank H1900 shown in FIG. 5. The tank holder H1500 also comprises an opening for a prism for use in detecting the amount of remaining ink. The tank holder H1500 further includes an installation guide for guiding a print head cartridge H1000 to an installation position of the carriage M4001 of the ink jet printing apparatus main body, an engagement section for installing and fixing the print head cartridge in the carriage M4001 by using a head set lever, and an X abutment section, a Y abutment section, and a Z abutment section for positioning the carriage M4001 at a predetermined installation position. The tank holder H1500 further includes a terminal fixing section for positioning and fixing the external-signal input terminals of the print element unit H1002, and a plurality of ribs provided in and around the terminal fixing section to improve the rigidity of a surface with the terminal fixing section. Furthermore, inter-color ribs are each provided in a corresponding boundary portion between install portions of the respective color inks where the ink tanks H1900 of respective color inks are installed, to prevent the color inks from being mixed together. Furthermore, the tank holder H1500 has a handling section on both sides thereof to allow the print head H1001 to be handled more easily. In addition, as shown in FIG. 5, the tank holder H1500 is a component which forms an ink passage for guiding the ink from the ink tank H1900 to the print element unit H1002 and the ink passage can be constructed by ultrasonically welding the flow passage forming member H1600.

Furthermore, a joint that engages with the ink tank H1900 has filters H1700 thermally welded thereto for preventing entry of dusts and a seal rubber H1800 according to this embodiment installed thereon for preventing the ink from evaporating from the joint section.

As shown in FIG. 11, the print head cartridge H1000 is completed by coupling the print element unit H1002 to the tank holder H1500. This coupling is carried out as follows:

A fourth adhesive is used to bond and fix the ink supply ports of the print element unit H1002 (the ink supply ports of the first plate H1200) to the corresponding ink supply ports of the tank holder H1500 (the ink supply ports of the flow passage forming member H1600) in such a manner that the former ink supply ports are in communication with the latter ink supply ports. In addition to the ink supply ports, several points of the print element unit H1002 which come in contact with the tank holder H1500 are bonded and fixed to corresponding points of the tank holder H1500, using a fifth adhesive. The fourth and fifth adhesives desirably resist the ink, harden at room temperature, and are soft enough to accommodate a difference in linear expansion coefficient between different types of materials; this embodiment uses, for example, moisture-absorption-hardening silicone adhesives. The fourth and fifth adhesive resins may be the same adhesives. Furthermore, when the print element unit H1002 and the tank holder H1500 are bonded together using the fourth and fifth adhesives, the print element unit H1002 is positioned and fixed using a sixth adhesive. Desirably, the sixth adhesive hardens instantaneously; this embodiment uses, for example, an ultraviolet-hardening adhesive but other adhesives may be used.

The external-signal input terminals of the print element unit H1002 are positioned and fixed to one side of the tank holder H1500 using two terminal positioning pins and two terminal positioning holes. A fixing of the external-signal input terminals is performed in a manner that the terminals can be fixed to the tank holder H1500 by, for example, fitting terminal coupling pins provided on the tank holder H1500, in terminal coupling holes formed around the external-signal input terminals of the electric wiring board H1300 and then thermally welding the terminal coupling pins. The fixing means, however, is not limited to this, but of course other means may be used.

Figure 13:
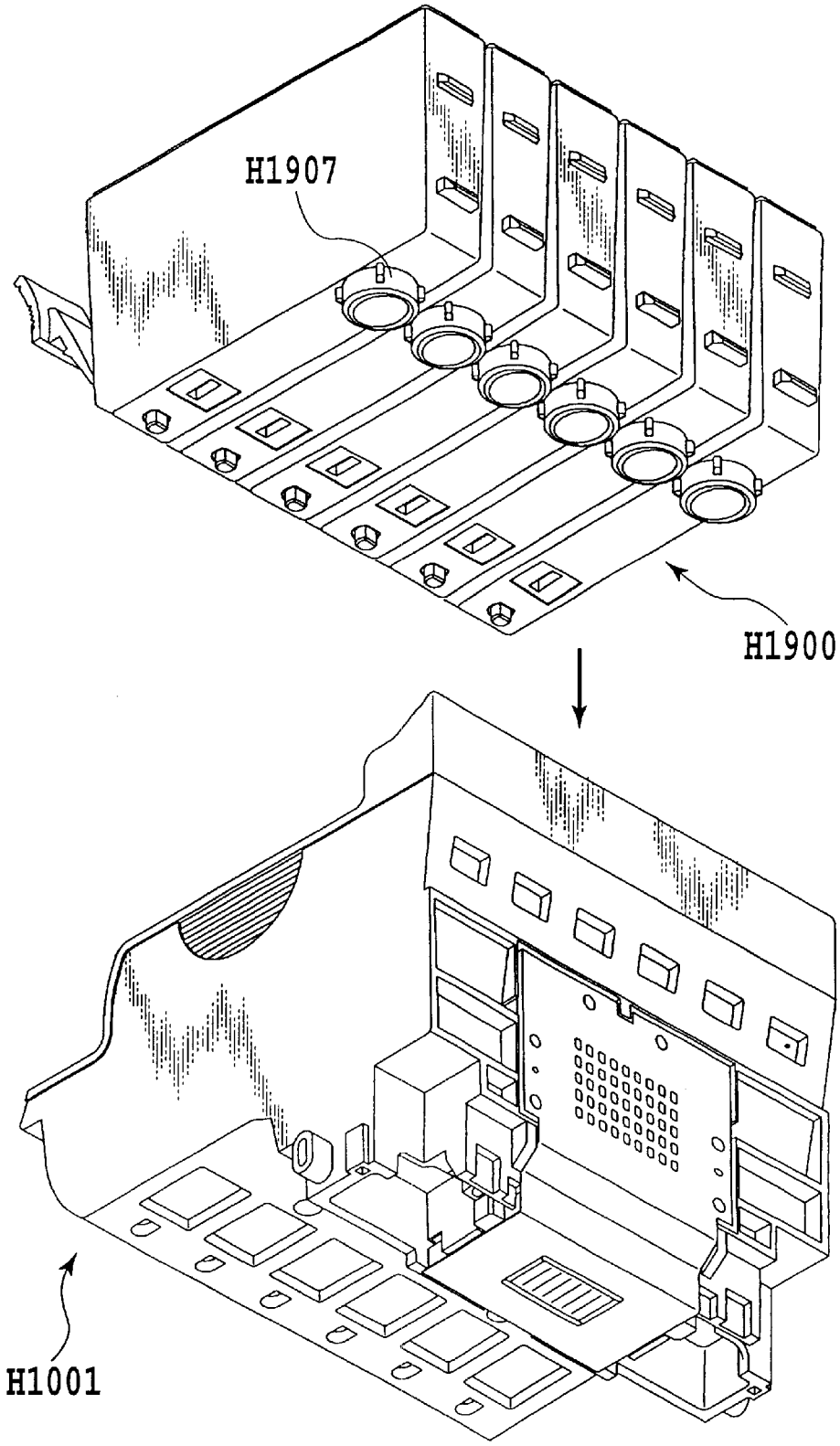
FIG. 13 is a perspective view of the print head cartridge and ink tanks shown in FIG. 3.

FIG. 13 is a view useful in explaining the above described print head cartridge further in detail.

This figure shows how the print head H1001 and the ink tanks H1900 constituting the print head cartridge H1000 are installed. The six ink tanks H1900 each has the corresponding color inks stored inside. Each ink tank has an ink supply port H1907 formed therein for supplying the ink therefrom to the print head H1001. For example, the leftmost ink tank H1900 in the figure stores black ink, which is supplied to the print head H1001 via the ink supply port H1907.

Figure 14:
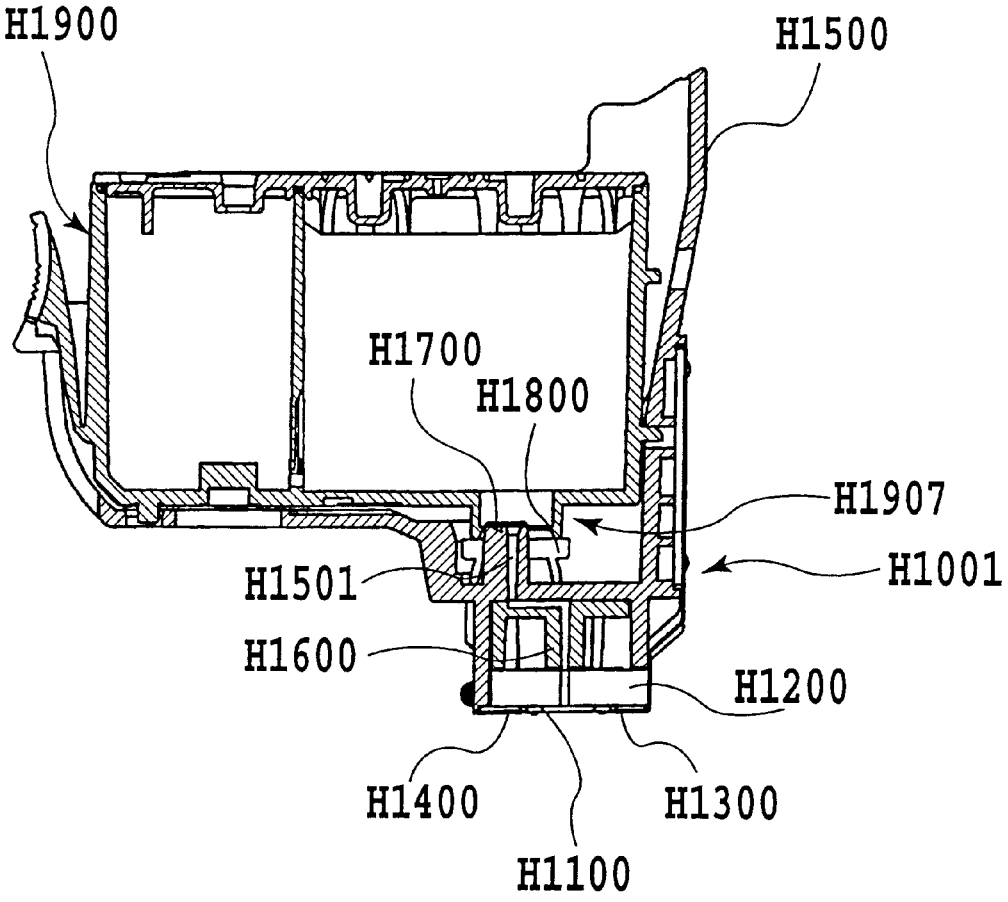
FIG. 14 is a sectional view of the print head cartridge shown in FIG. 3.

FIG. 14 is a sectional view showing the above described print head cartridge H1000.

As shown in FIG. 14, the box-shaped print head H1001 has the print element substrate H1100 provided on one side of a bottom surface thereof. In addition, the print head H1001 has the joint as described above, in which the ink passage H1501 extending toward the print element substrate 1100 is formed.

The flow of the ink through this print head cartridge will be described taking the ink tank H1900 for the black ink by way of example. The ink in the ink tank H1900 is supplied to an interior of the print head H1001 via the ink supply port 1907 and the joint. The ink supplied to the interior of the print head H1001 is then supplied to the first plate H1200 via the ink passage H1501 and further to the ink supply port H1102 of the print element substrate H1100. The ink is further supplied to a bubbling chamber having the electro-thermal conversion elements H1103 (see FIG. 12) and the ejection openings H1100T (see FIG. 12) formed therein. The ink supplied to the bubbling chamber generates bubbles under thermal energy generated by the electro-thermal conversion elements H1103, so that the pressure of the bubbles causes the ink to be ejected.

2.2 Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 transfer various information for printing and supply electricty to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the subscan direction enables one page of document image information to be read.

Figure 6B:
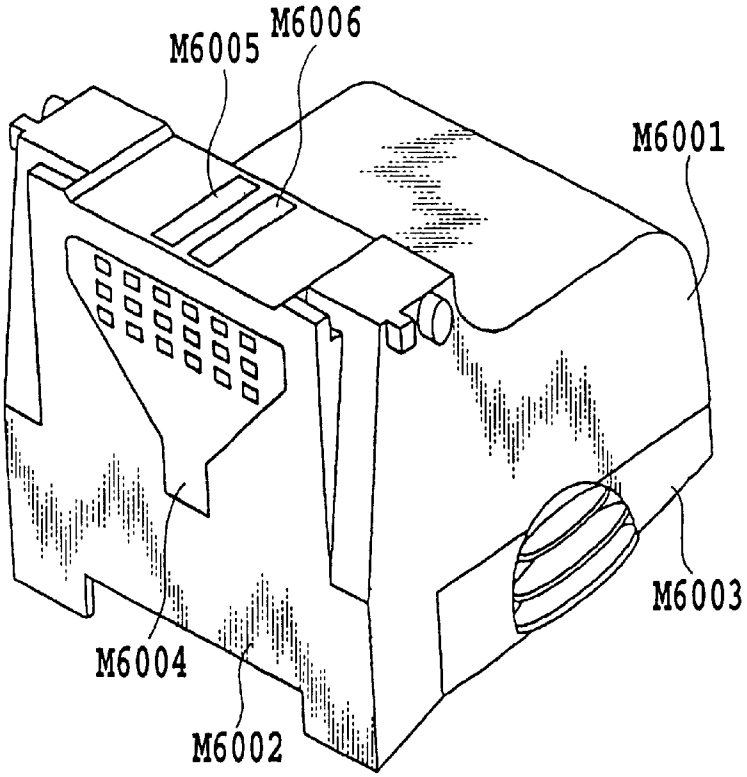
FIGS. 6A and 6B are perspective views showing a construction of a scanner cartridge upside down which can be mounted in the printer of one embodiment of the present invention instead of the print head cartridge of FIG. 3.
Figure 6A:
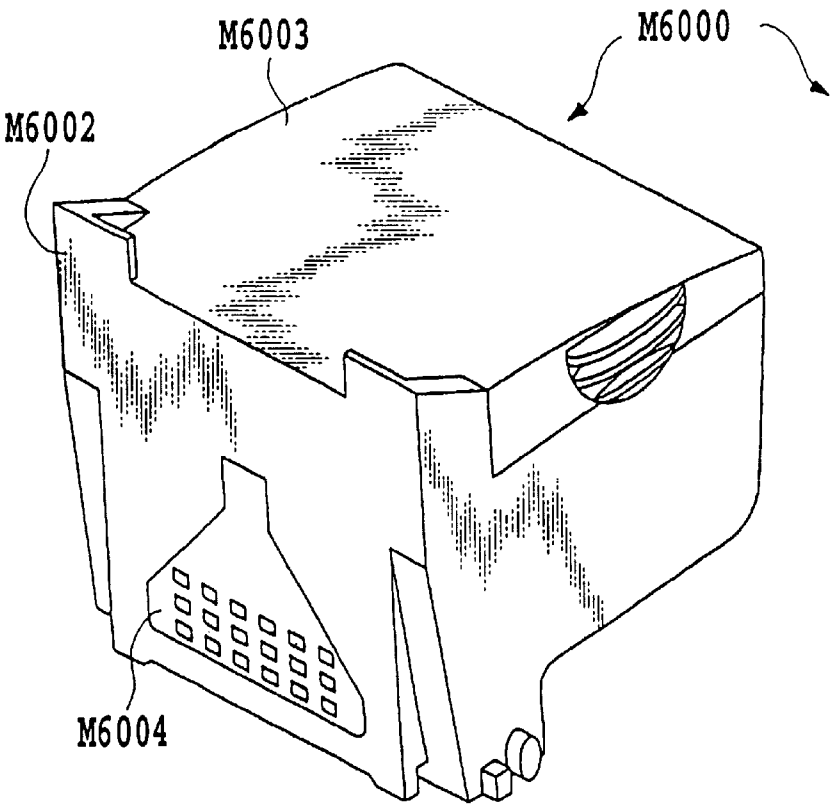

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
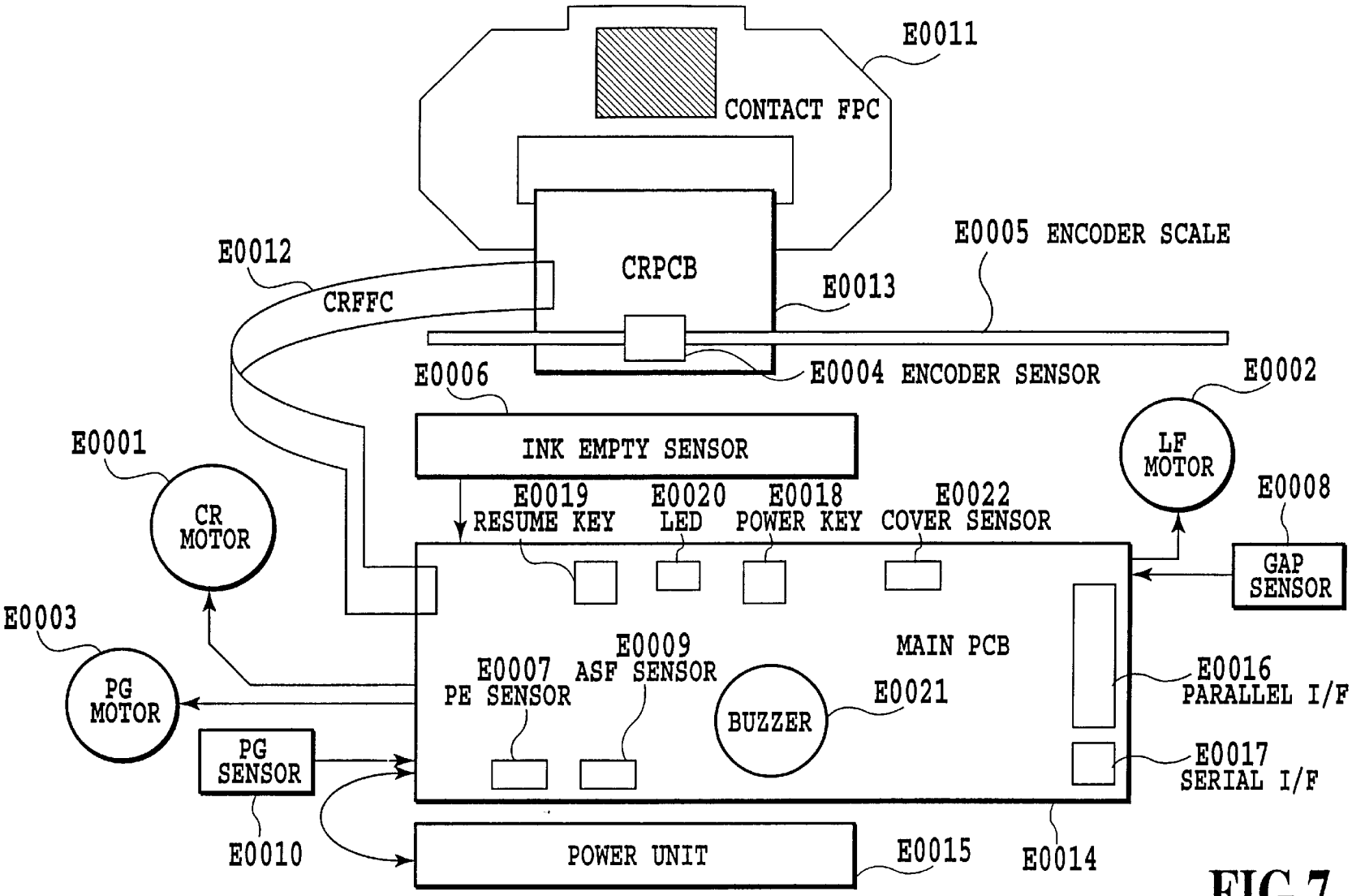
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED 0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
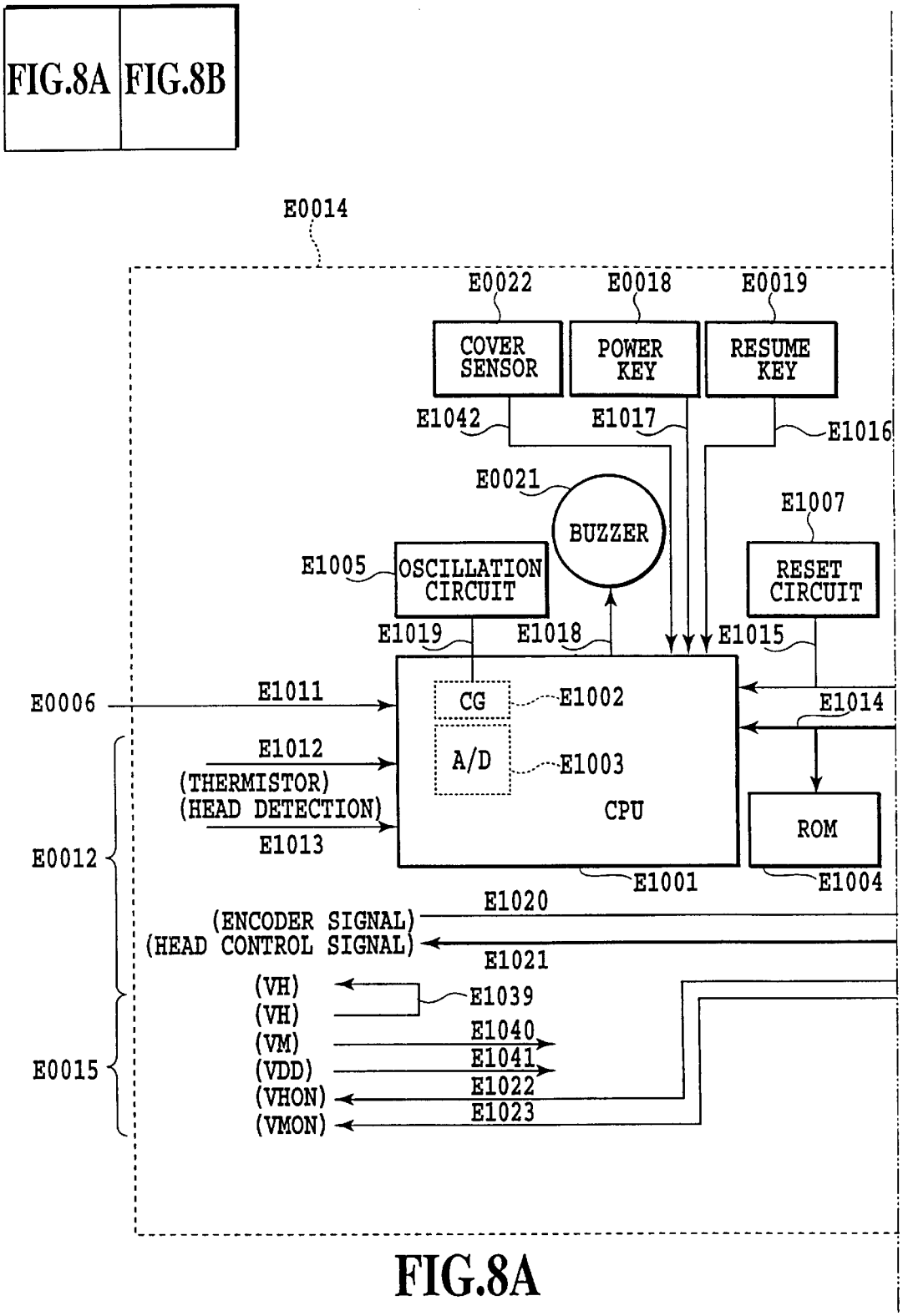
FIG. 8 is a diagram showing the relation between FIGS. 8A and 8B, FIGS. 8A and 8B being block diagrams representing an example inner configuration of a main printed circuit board (PCB) in the electric circuitry of FIG. 7.
Figure 8B:
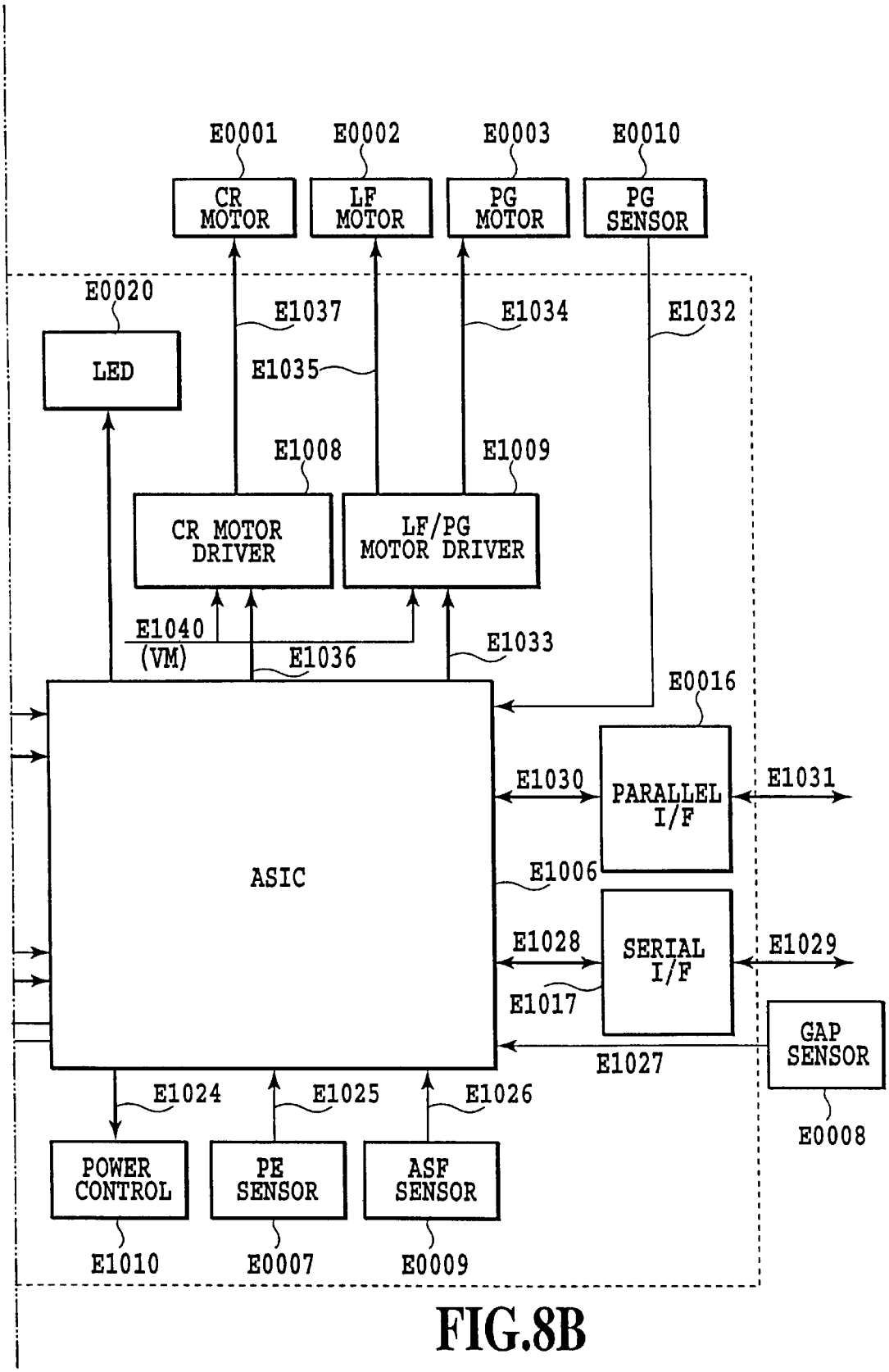

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PE sensor E0007, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
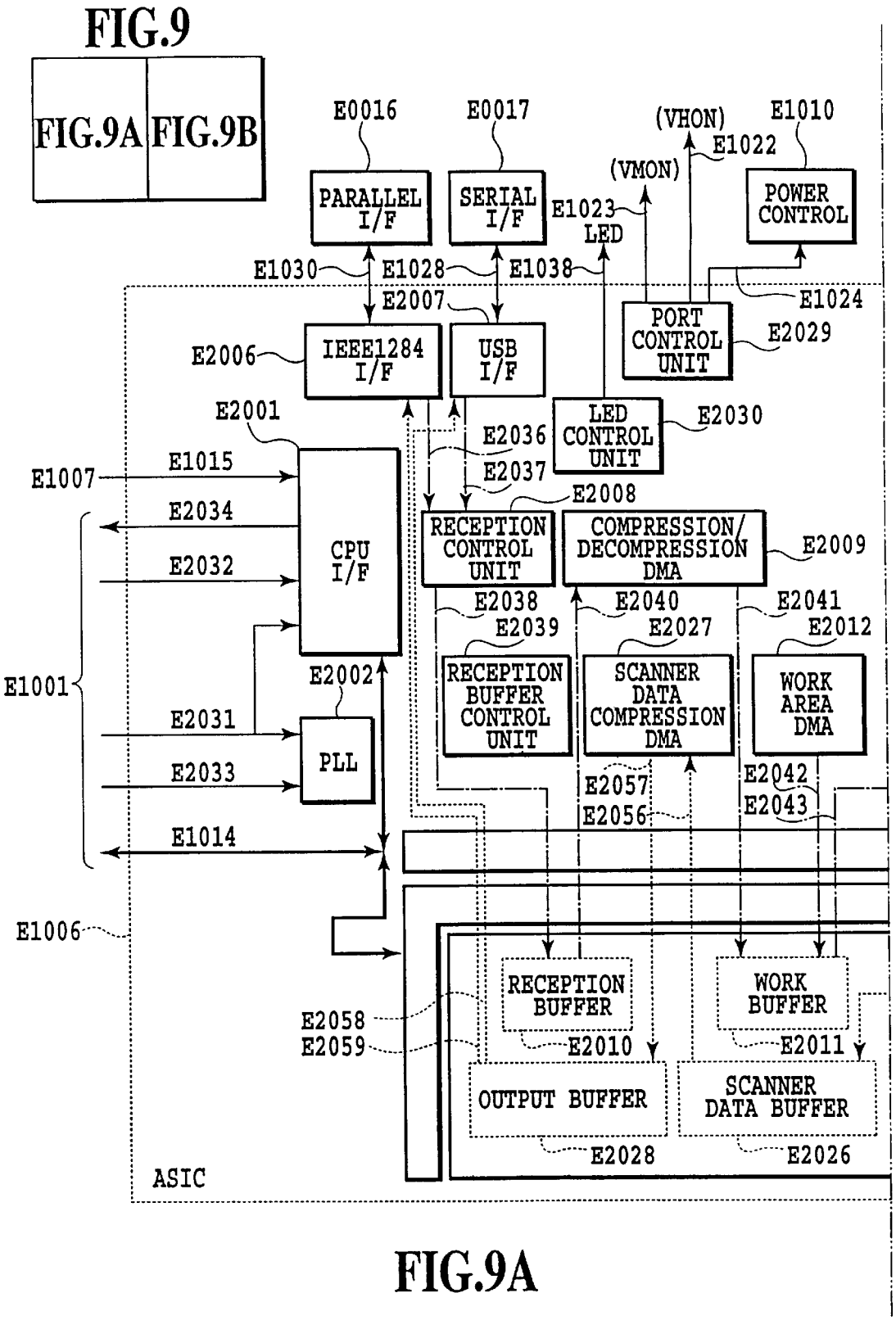
FIG. 9 is a diagram showing the relation between FIGS. 9A and 9B, FIGS. 9A and 9B being block diagrams representing an example inner configuration of an application specific integrated circuit (ASIC) in the main PCB of FIGS. 8A and 8B.
Figure 9B:
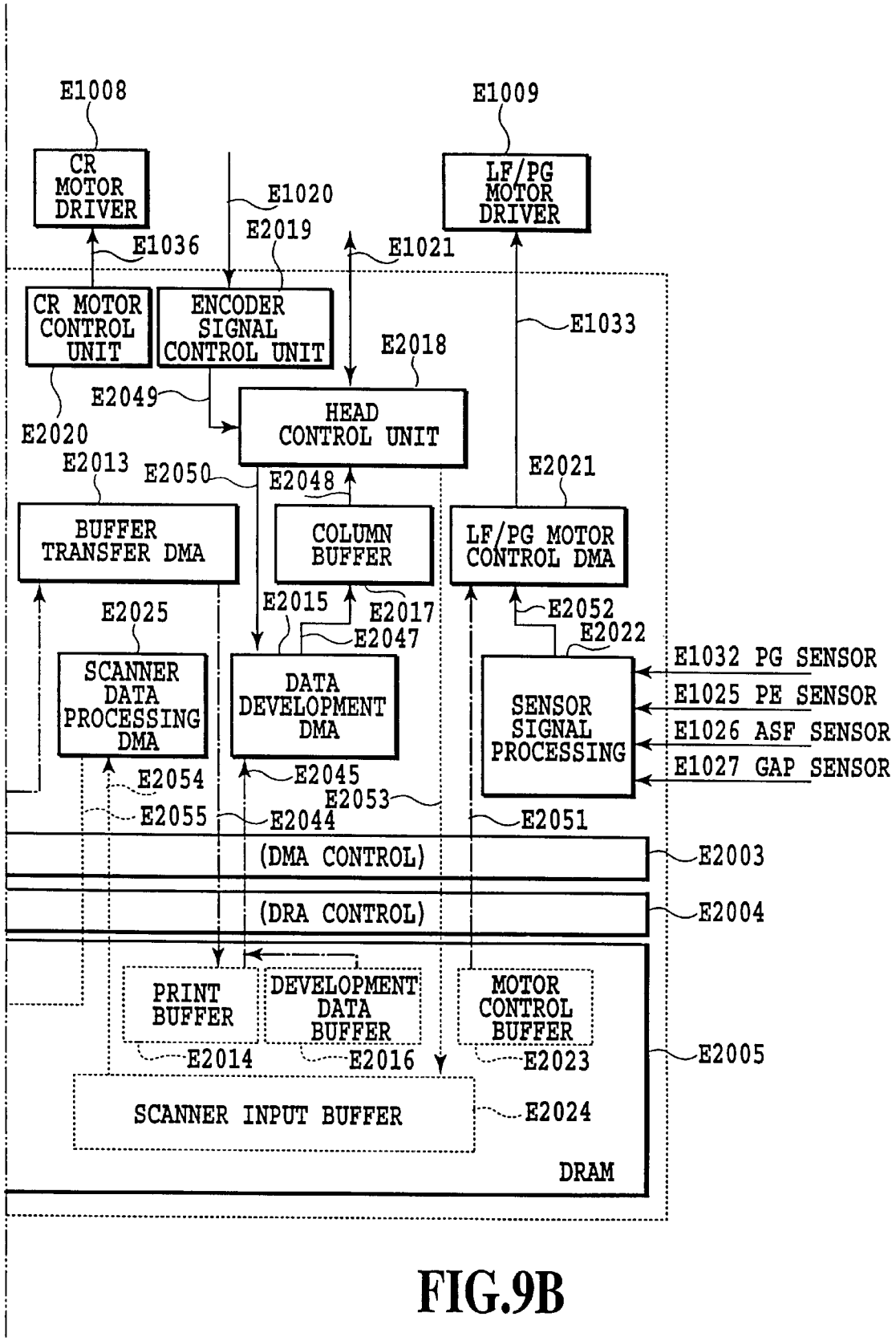

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is a 1284 I/F which functions as a bi-directional communication interface with external host devices, not shown, through the parallel I/F E0016 and is controlled by the CPU E1001 via CPU I/F E2001. During the printing operation, the 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
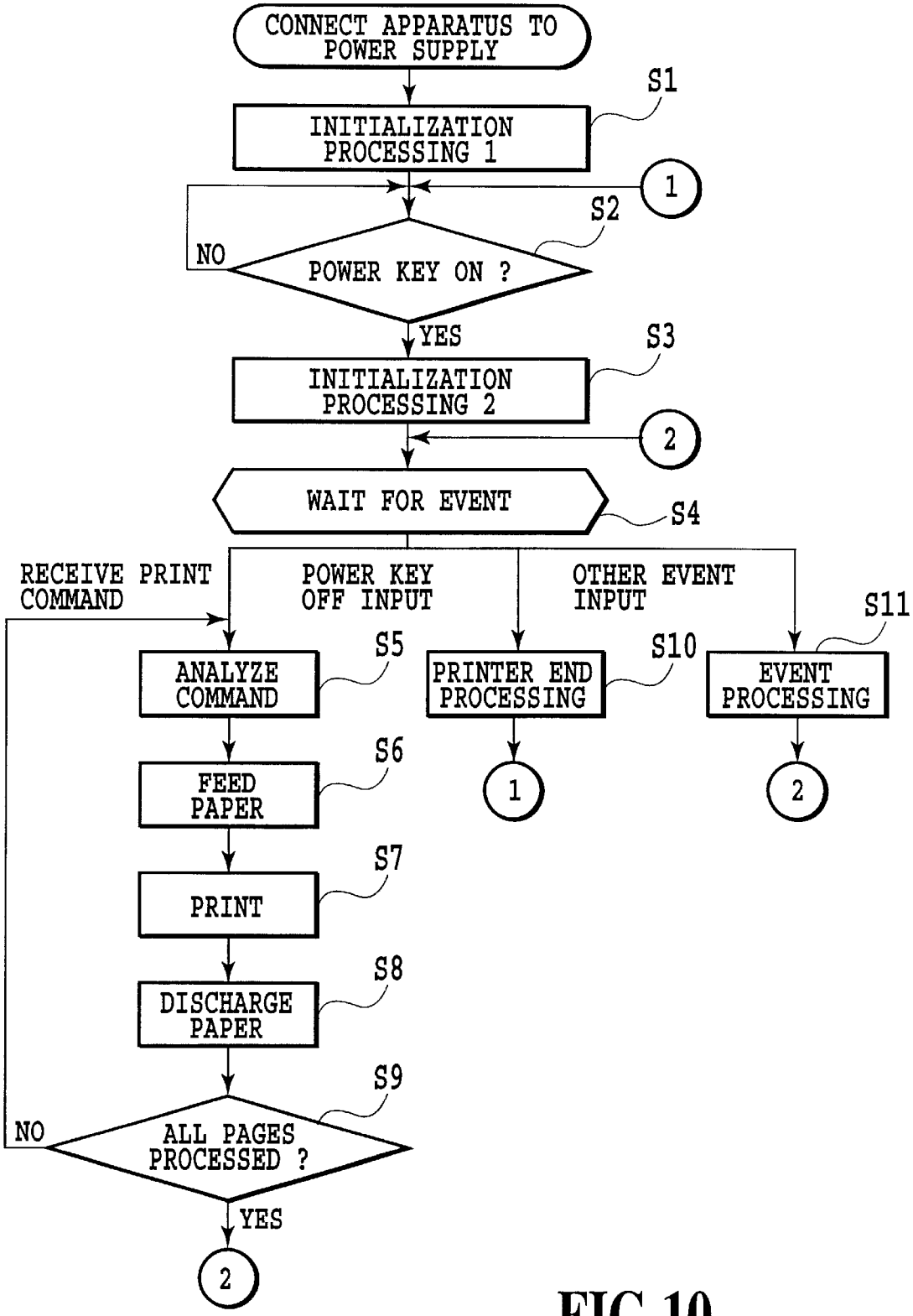
FIG. 10 is a flow chart showing an example of operation of the printer as one embodiment of the present invention.

Next, the operation of the ink jet printing apparatus in this embodiment of the invention with the above configuration will be explained by referring to the flow chart shown in FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any-of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004*a*.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

Embodiment 1

A first embodiment of a seal rubber as a covering rubber member for use in an ink jet printer which has been described with reference to FIGS. 1 to 14 will be explained below.

Figure 15A:
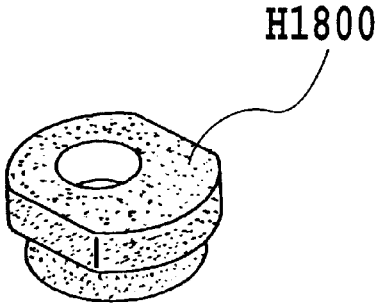
FIGS. 15A and 15B are perspective views of a seal rubber according to a first embodiment of the present invention as seen from above and below, respectively.
Figure 15B:
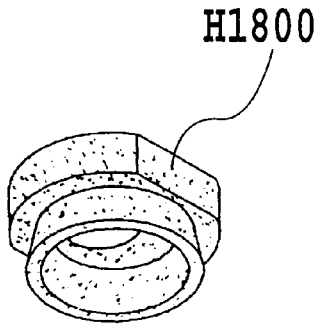
Figure 16A:
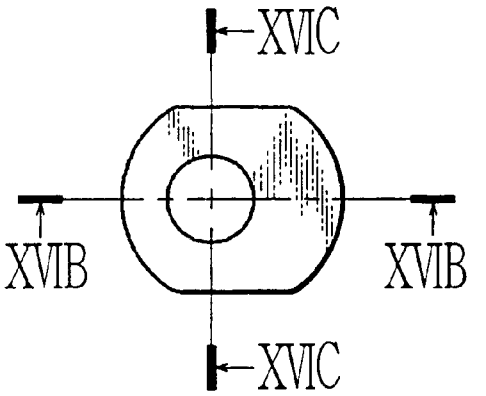
FIGS. 16A, 16B, 16C and 16D are a top view, a transverse sectional view, a longitudinal sectional view, and a bottom view of the seal rubber shown in FIGS. 15A and 15B, respectively.
Figure 16B:
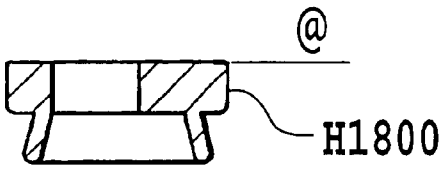
Figure 16C:
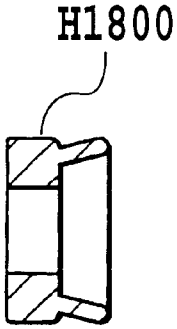
Figure 16D:
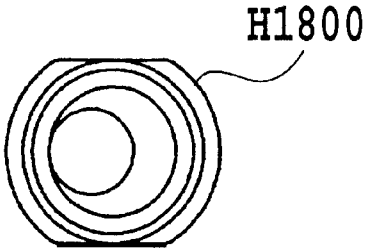

The seal rubber according to this embodiment is used for the joint section between the print head and the ink tank in the print head cartridge. FIGS. 15A, 15B and FIGS. 16A, 16B show this seal rubber. FIGS. 15A and 15B are perspective views of the seal rubber as seen from above and below, respectively, FIG. 16A is a top view thereof, FIG. 16B is a sectional view taken along a line XVIB—XVIB in FIG. 16A, FIG. 16C is also a sectional view taken along a line XVIC—XVIC in FIG. 16A and FIG. 16D is a bottom view as seen from below.

The seal rubber H1800 according to this embodiment is of EPDM (ethylene propylene rubber), which is soft and relatively inexpensive and appropriately seals an object. As shown in FIGS. 15A and 15B, the seal rubber H1800 is subjected to a roughened finish ("roughened finish" means that a surface is roughened) all over its surfaces. The "roughened surface" is formed on the seal rubber by that the seal rubber is manufactured by means of a mould which is subject to a sand blast process.

The surface roughness of the seal rubber achieved by this roughened finish is between 10 $\mu$m and 15 $\mu$m in terms of a center line mean height (Ra) in accordance with JIS B0601. With a roughened finish for such a surface roughness, when the seal rubbers H1800 are handled in a mutually contacting manner on manufacturing the print head, for example, when a parts feeder handles a large number of mixed seal rubbers before supply as described above, they can be prevented from sticking mutually and affecting the manufacturing process. Also this degree of roughness enables the joint section to be properly sealed as described below. Furthermore, the roughened finish for the surface roughness of only 5 $\mu$m or less has been confirmed to insufficiently prevent the mutual sticking of the seal rubbers.

In this embodiment, the surface roughness was measured using a contact roughness gauge (SurfCom (form 570A) manufactured by Tokyo Precision Co. Ltd.). In addition, the measurement conditions are the drive speed of 0.3 mm/s, the measurement length of 2.5 mm, the CUTOFF of 0.8 mm, the V-MAG of 2,000 and the H-MAG of 20.

To determine the surface roughness of the roughened finish for the seal rubber according to this embodiment, the following experiments were made:

Seal rubbers subjected to roughened finishes with varying values of surface roughness were tested for evaporation from the ink tank.

With the ink tanks installed in the print head as shown in FIGS. 3 and 14, an accelerate-leaving test were conducted in an atmosphere at 45° C. for 30 days to determine the rate at which the ink evaporated from the ink tank. More specifically, the unit of the print head and the ink tank where the seal rubber is used to the joint between them and the print head is capped (in the same capping condition in which the unit is installed in the printer) is left in the atmosphere at 45° C. and a weight of the ink tank is measured at predetermined interval.

The surfaces roughness of the seal rubbers were set at following four kinds of roughness:

① No roughened finish

② Roughened finish: the center line mean height (Ra) (JIS B 0601) is 12.5 $\mu$m.

③ Roughened finish: the center line mean height (Ra) (JIS B 0601) is 18.0 $\mu$m.

④ Roughened finish: the center line mean height (Ra) (JIS B 0601) is 25.0 $\mu$m.

Figures 17A, 17B:
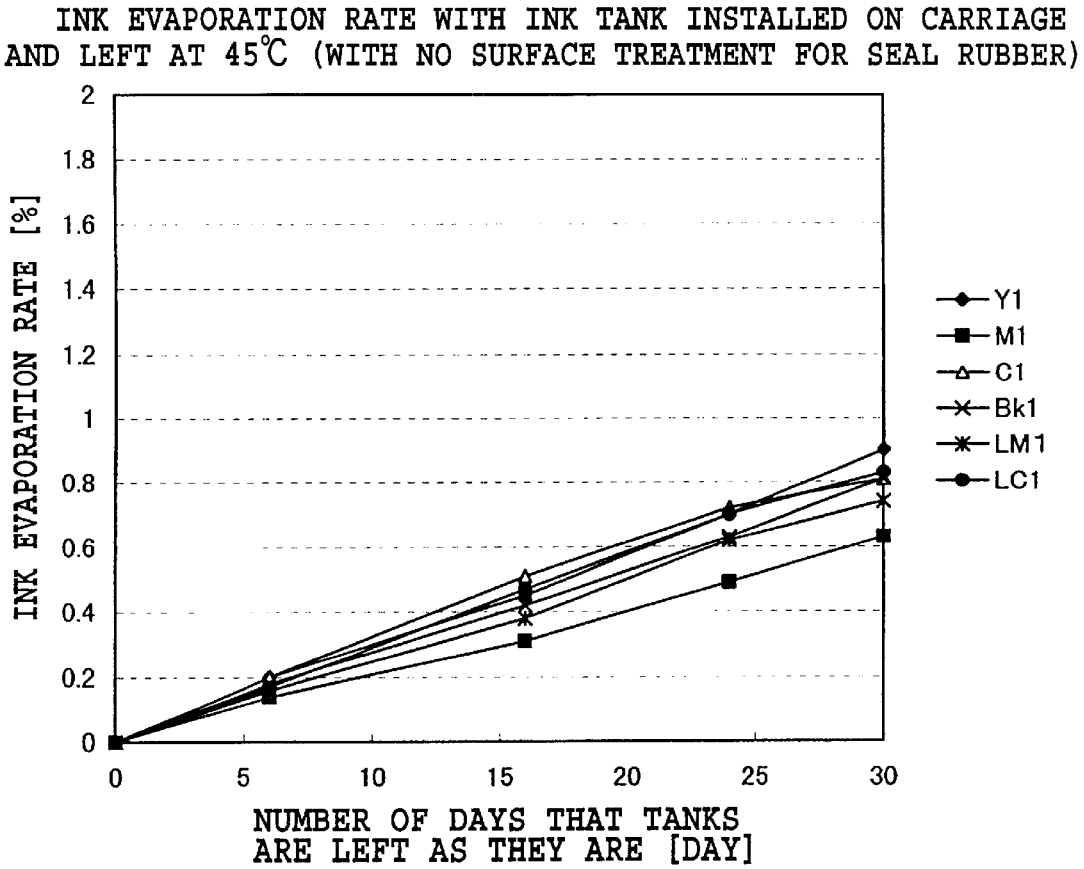
FIGS. 17A and 17B are diagrams for explaining a rate of ink evaporation from an ink tank observed when a surface roughness of the seal rubber shown in FIGS. 15A and 15B, which is achieved by a roughened finish, is varied.
Figures 18A, 18B:
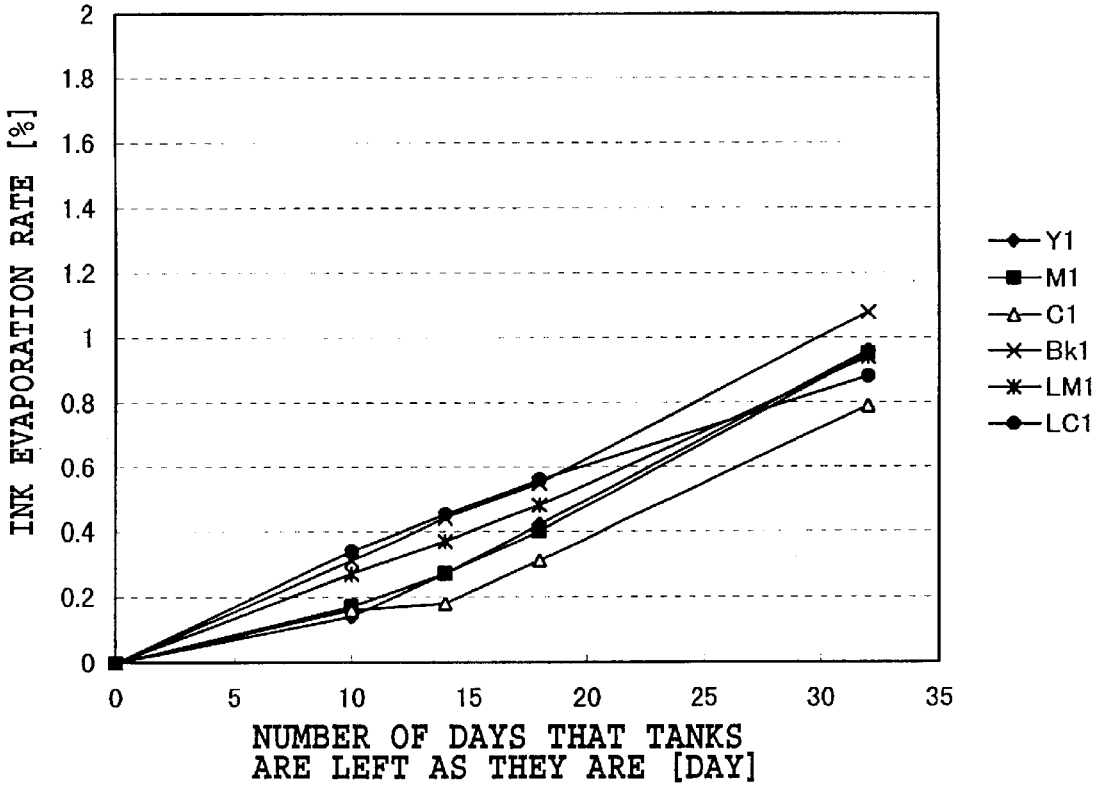
FIGS. 18A and 18B are diagrams for explaining the rate of ink evaporation from the ink tank observed when the surface roughness of the seal rubber shown in FIGS. 15A and 15B, which is achieved by the roughened finish, is varied.
Figures 19A, 19B:
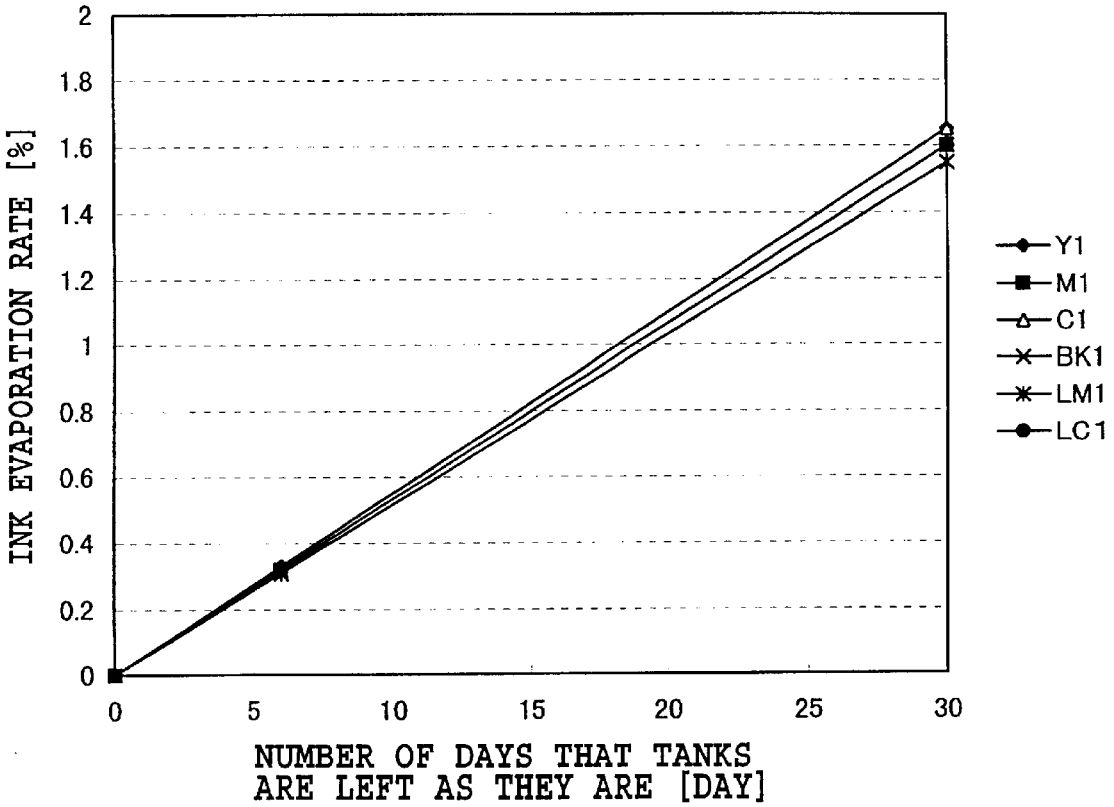
FIGS. 19A and 19B are diagrams for explaining the rate of ink evaporation from the ink tank observed when the surface roughness of the seal rubber shown in FIGS. 15A and 15B, which is achieved by the roughened finish, is varied.
Figures 20A, 20B:
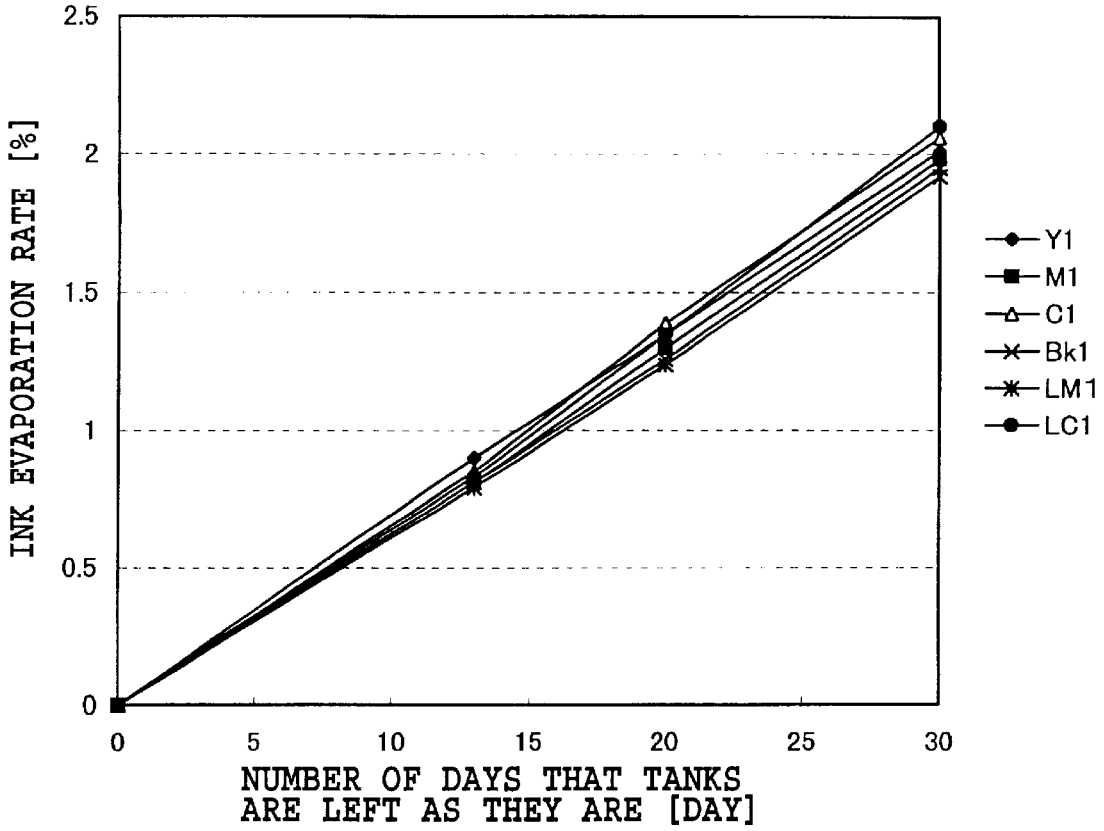
FIGS. 20A and 20B are diagrams for explaining the rate of ink evaporation from the ink tank observed when the surface roughness of the seal rubber shown in FIGS. 15A and 15B, which is achieved by a roughened finish, is varied.

FIGS. 17A, 17B to 20A, 20B show respective relations between an ink evaporation rate and a number of days during which the ink tank and the print head are left, with respect to seal rubbers of the four kinds of roughness each of which is used for the joint section between each of the six ink tanks and the print head in the print head cartridge. FIGS. 17A and 17B are respectively a table and a graph showing the relation for the seal rubber of the kind ①. Similarly, FIGS. 18A and 18B for the seal rubber the kind ②, FIGS. 19A and 19B for the seal rubber of the kind ③ and FIGS. 20A and 20B for the seal rubber of the kind ④. In addition, in these figures, Bk1 refers to the ink evaporation rate (%) for the black ink tank, LC1 refers to the ink evaporation rate for the light cyan ink tank, LM1 refers to the ink evaporation rate for the light magenta ink tank, C1 refers to the ink evaporation rate for the cyan ink tank, M1 refers to the ink evaporation rate for the magenta ink tank, and Y1 refers to the ink evaporation rate for the yellow ink tank.

Desirably, a reference value for the ink evaporation rate is 2% or less regardless of the number of days that the ink tank and the print head are left as they are, taking into consideration effects on printing quality and ink ejection characteristic of the concentration of a dye in the ink, which varies due to the evaporation. Thus, the seal rubbers of the kinds ①, ② and ③ shown in FIGS. 17A, 17B, FIGS. 18A, 18B and FIGS. 19A, 19B exhibit a sealing ability where the evaporation rate becomes lower than the reference value. On the other hand, the evaporation rate of the seal rubber of kind ④ shown in FIGS. 20A, 20B may exceed the value depending on the number of days during which the ink tank and the print head are left. This indicates that the roughened finish for the seal rubber of the kind ④ reduces the sealing ability.

These experimental results indicate that the seal rubbers of kinds ① to ③ create no problem with the surface roughness achieved by means of the roughened finish, whereas the seal rubber of the kind ①, which is subjected to no roughened finish, cannot be prevented from sticking. In view of these points, the mean height is desirably set between 5 and 20 $\mu$m.

Although this embodiment employs the inexpensive EPDM (ethylene propylene rubber) as a seal rubber material, chlorinated butyl rubber or silicone rubber, which is more excellent in resistance to ink wetting, may be used.

Embodiment 2

Figure 21A:
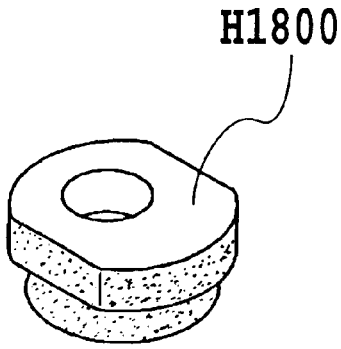
FIGS. 21A and 21B are perspective views of a seal rubber according to a second embodiment of the present invention.
Figure 21B:
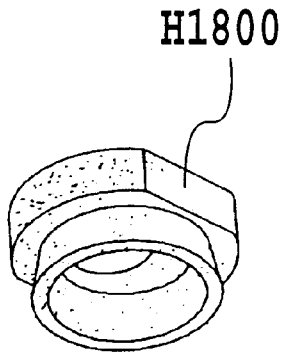

FIGS. 21A and 21B show a seal rubber as a covering rubber member according to a second embodiment of the present invention. FIG. 21A is a perspective view as seen from above the seal rubber, and FIG. 21B is a perspective view as seen from below the seal rubber. The seal rubber according to this embodiment is used for the joint section between the ink tank and the print head similarly to Embodiment 1.

The seal rubber according to this embodiment has top surface which is subjected to no roughened finish as shown in FIG. 21A, while having the other surfaces subjected to a roughened finish. The top surface is the surface shown by @ in FIG. 16B and is surface which comes in contact, at the joint section, with the surface of the ink supply port of the ink tank. That is, only this surface, which comes in contact with the ink supply port, is subjected to no roughened finish so as to allow the seal rubber to sufficiently exhibit its inherent sealing ability. In this case, the surfaces subjected to no roughened finish are unlikely to contact mutually due to the shape of the seal rubber according to this embodiment. More specifically, in conditions where the seal rubber according to this embodiment is placed, the-seal rubber is commonly placed in such a manner that the surface subjected to no roughened finish or the opposite surface faces downward. As a result, even if the seal rubbers come in mutual contact, their contact surfaces are likely to be subjected to a roughened finish. Therefore, the seal rubber according to this embodiment is also sufficiently prevented from sticking during manufacture of print heads.

Embodiment 3

Figure 22:
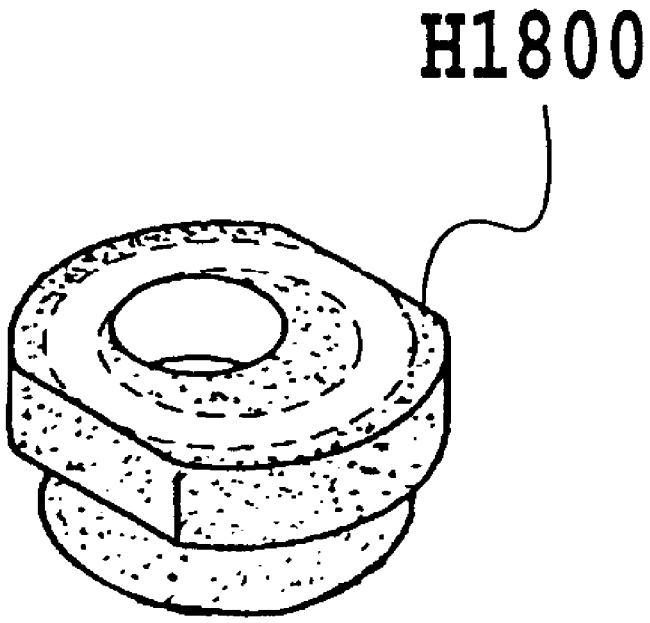
FIG. 22 is a perspective view showing a seal rubber according to a third embodiment of the present invention.

FIG. 22 is a perspective view showing a seal rubber as a covering rubber member according to a third embodiment of the present invention. The seal rubber according to this embodiment is also used for the joint section of the print head cartridge.

As shown in FIG. 22, in the seal rubber according to this embodiment, only a donut-shaped part of its surface that comes in contact with the ink supply port of the ink tank at the joint section is subjected to no roughened finish; this donut-shaped part corresponds to a range that actually comes in contact with the ink supply port.

This embodiment provides a higher sticking prevention effect than the above described Embodiment 2.

Embodiment 4

In this embodiment, the present invention is applied to a storage box cap as a covering rubber member, which is used for a storage box for a print head.

Figure 23:
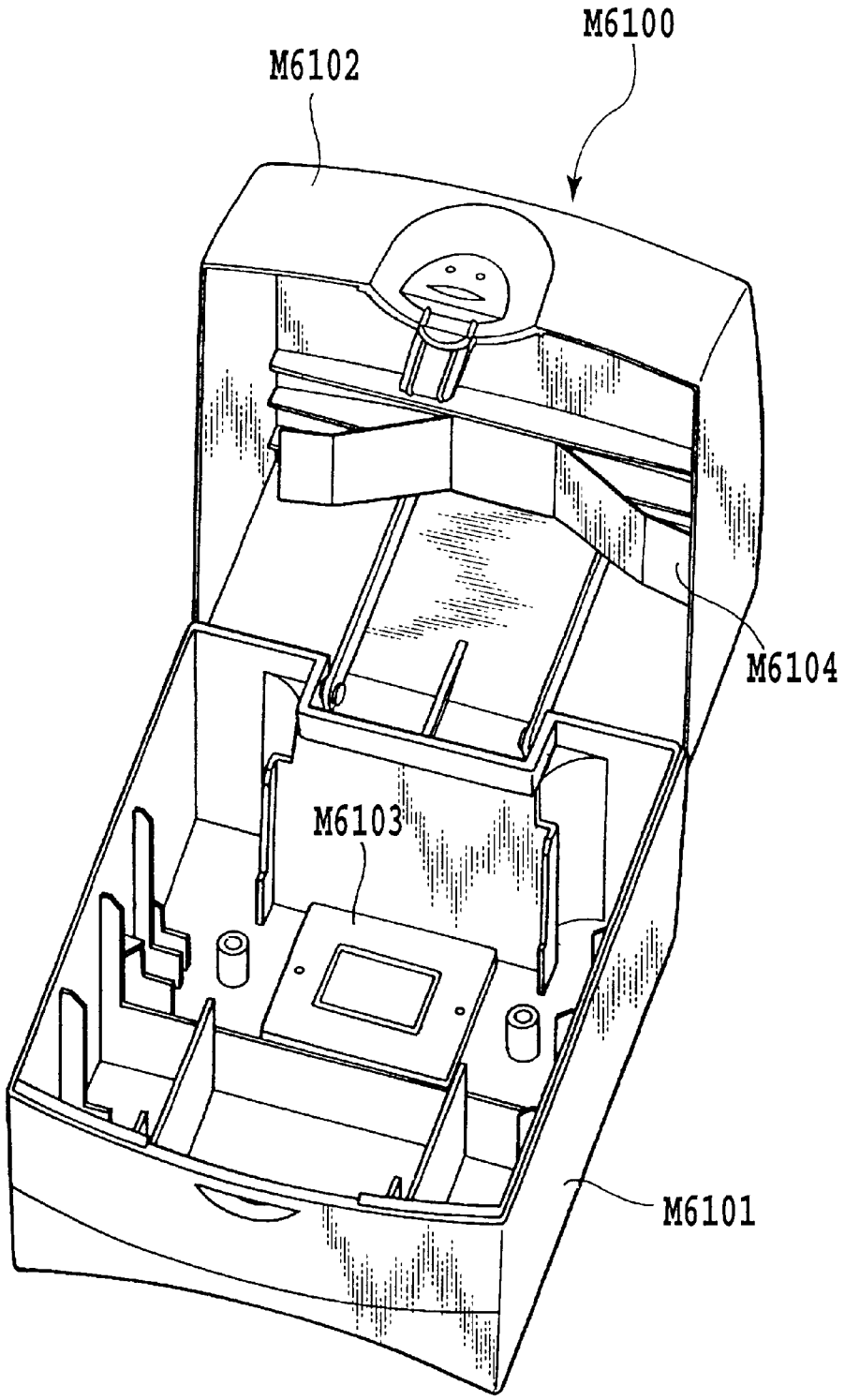
FIG. 23 is a perspective view showing a print head storage box according to a fourth embodiment of the present invention.

FIG. 23 is a view showing a storage box M6100 for storing the above-described print head H1001.

The storage box M6100 comprises a storage box base M6101 having an opening at a top thereof, a storage box cover M6102 pivotably attached to the storage box base M6101 so as to open and close the opening of the base M6101, a storage box cap M6103 according to this embodiment which is fixed to a bottom of the storage box base M6101, and a storage box spring M6104 in a form of a sheet spring which is fixed to an inner top surface of the storage box cover M6102.

To store the print head in the storage box configured as described above, the print head is inserted into the storage box base M6101 in such a manner that the ejection opening section of the print head H1001 is opposed to the storage box cap M6103, the storage box cover M6102 is then closed to engage a locking section of the storage box base M6101 with the storage box cover M6102 to maintain the storage box cover M6102 occluded. In this occluded state, the storage box spring M6104 presses the print head H1001, so that the ejection opening section of the print head H1001 is covered with and sealed by the storage box cap M6103. Consequently, this storage box can store the print head while preventing attachment of dusts to the ejection opening and ink evaporation, thereby maintaining the print head in proper conditions over a long time.

Figure 24:
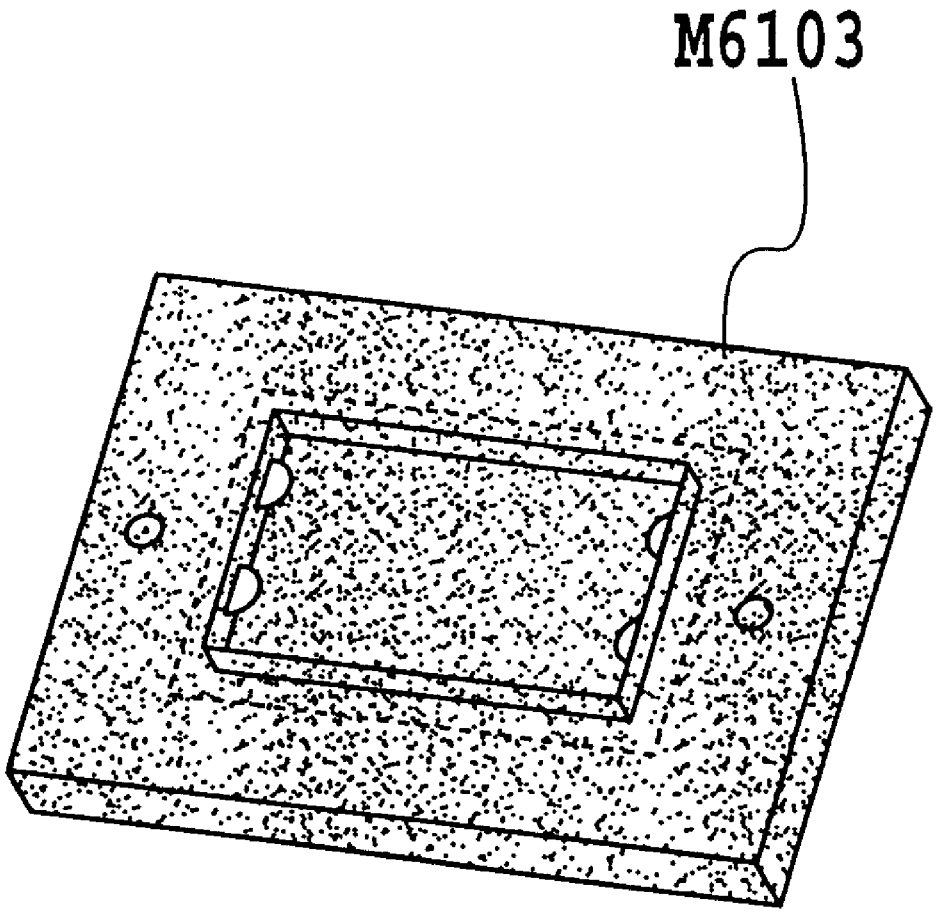
FIG. 24 is a perspective view of a storage box cap for use in the storage box shown in FIG. 23.

FIG. 24 is a perspective view showing the storage box cap M6103 used for the storage box M6100.

As shown in FIG. 24, the storage box cap M6103 is subjected to the roughened finish all over its surfaces. According to this embodiment, the roughened finish of the center line mean height (Ra) (JIS B0601) between 5 $\mu$m and 20 $\mu$m serves to prevent the storage box caps M6103 from sticking mutually when they come in mutual contact during a process for manufacturing storage boxes, similarly to Embodiment 1. Thus, the storage box cap can be handled more easily during the manufacturing process; for example, the storage box cap can be integrated more easily into the storage box base of the storage box.

Embodiment 5

Figure 25:
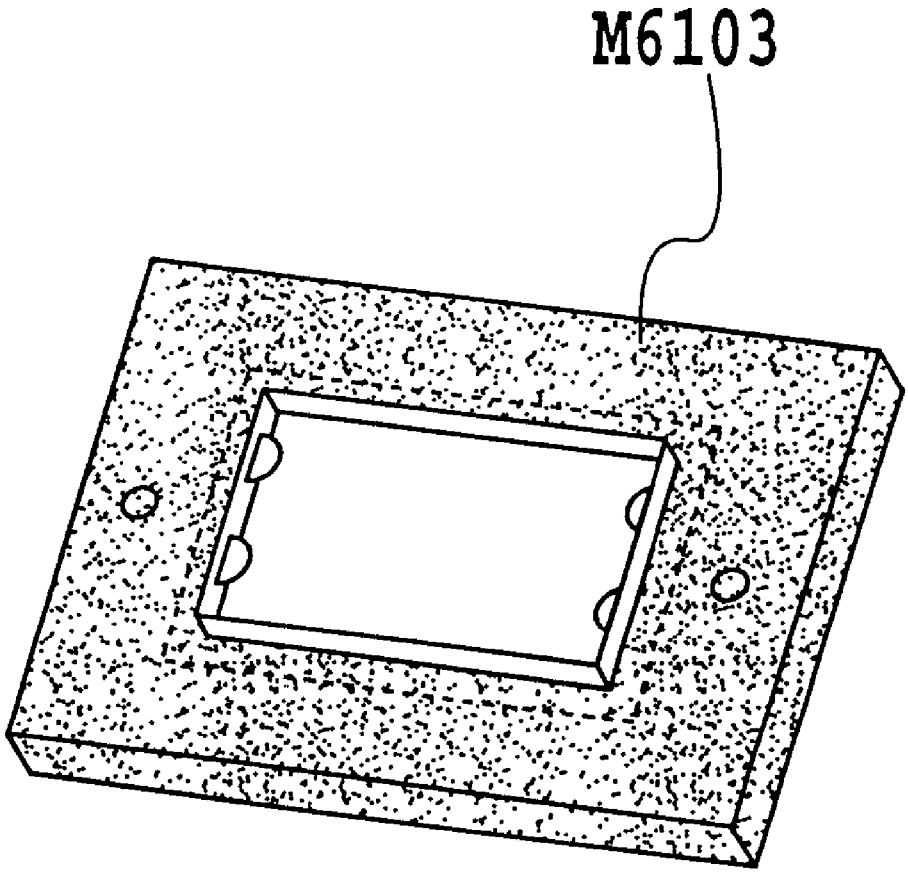
FIG. 25 is a perspective view of a storage box cap according to a fifth embodiment of the present invention.

This embodiment relates to another example of the storage box cap according to the fourth embodiment, and FIG. 25 is a perspective view thereof.

In FIG. 25, parts of the storage box cap M6103 other than the one coming in contact with the ejection opening section of the print head H1001 are subjected to the roughened finish. In this case, effects similar to those of the embodiment shown in FIG. 22 are obtained.

Embodiment 6

In this embodiment, the present invention is applied to a cap as a covering rubber member which is used for an ejection recovery section of the ink jet printing apparatus main body shown in FIGS. 1 and 2, the recovery section executing an ejection recovery process.

Figure 26:
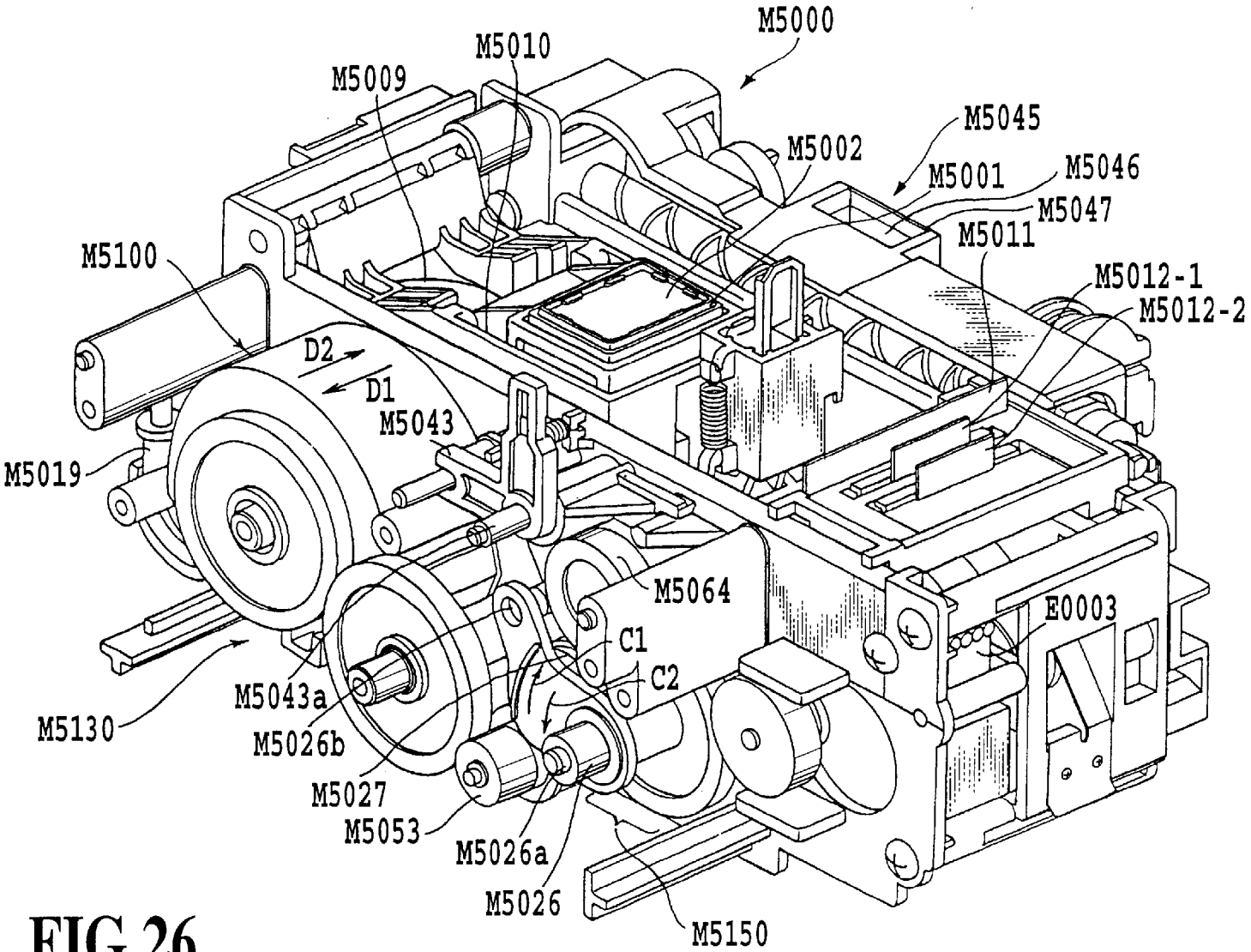
FIG. 26 is a perspective view showing an ejection recovery mechanism according to a sixth embodiment of the present invention.
Figure 27:
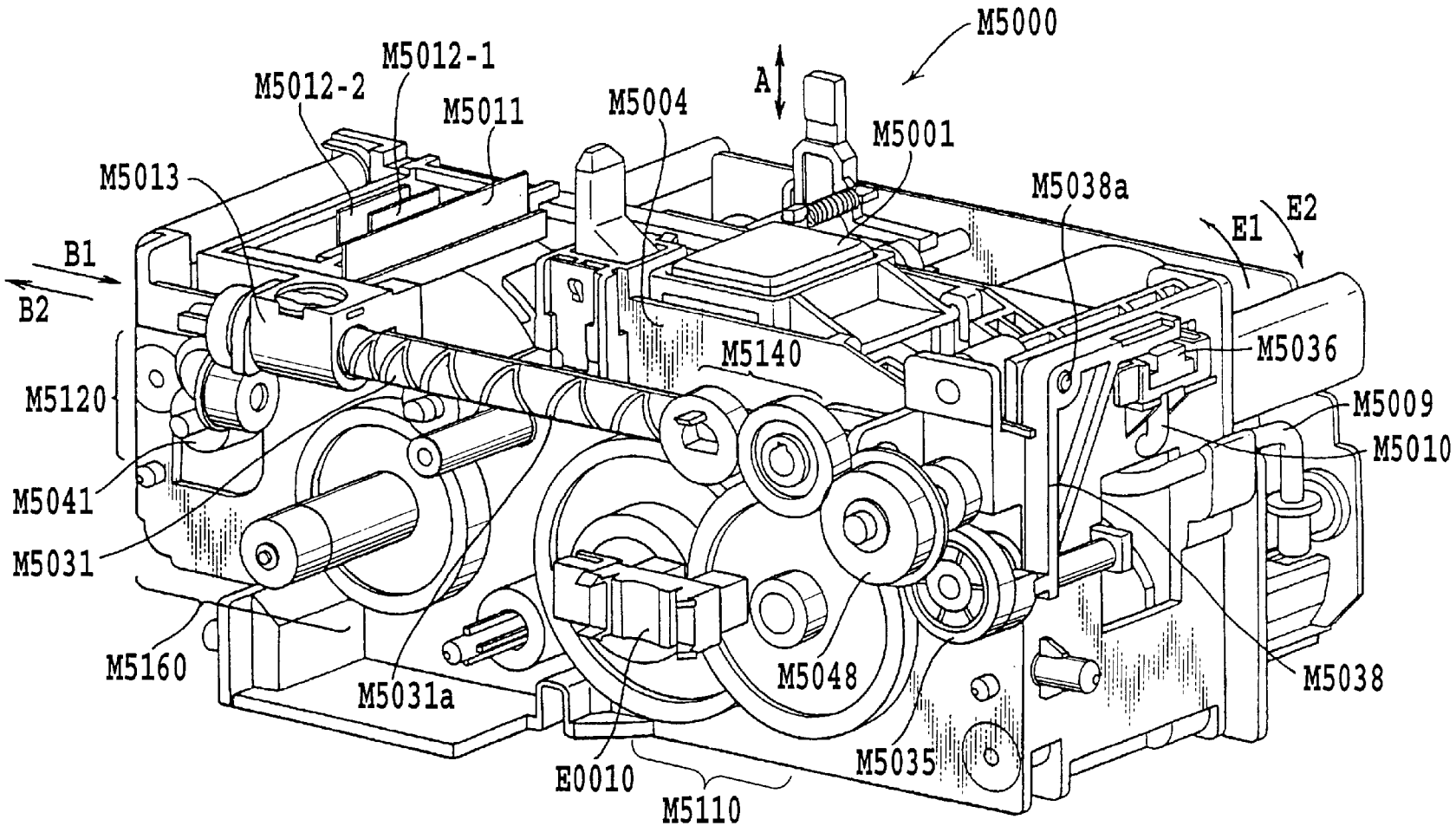
FIG. 27 is a perspective view showing the ejection recovery mechanism according to the sixth embodiment of the present invention.
Figure 28B:
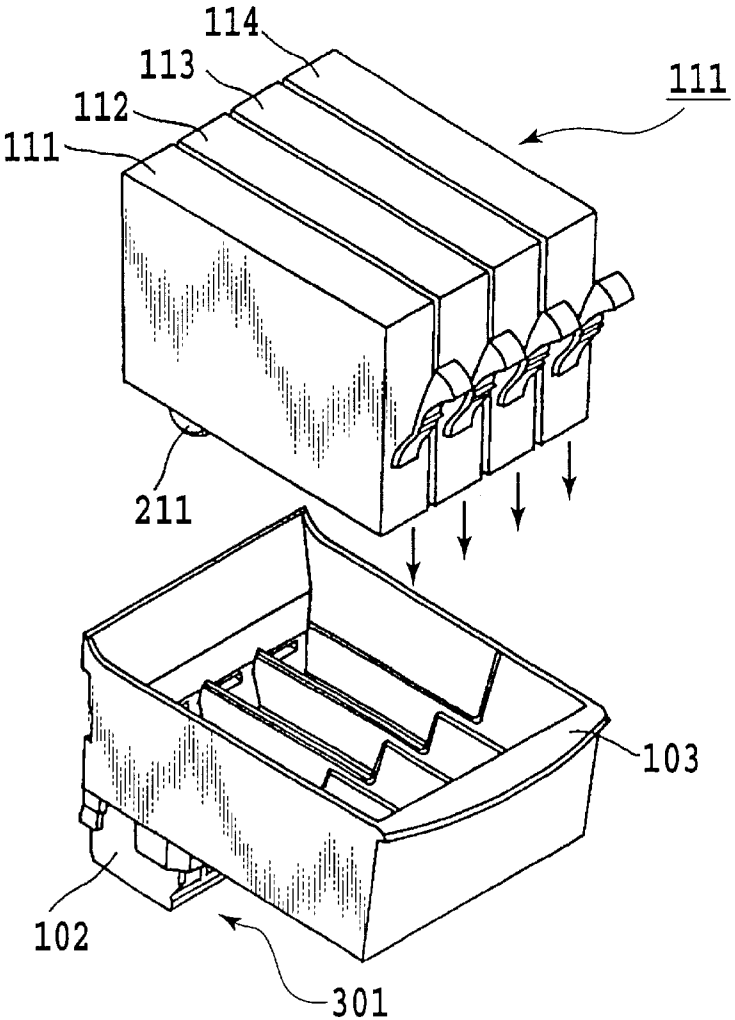
FIGS. 28A and 28B are perspective views showing a conventional print head cartridge.
Figure 28A:
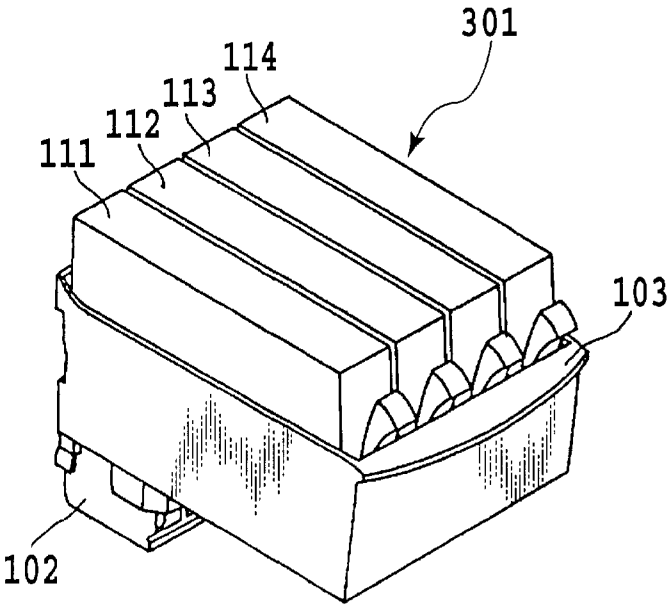
Figure 29A:
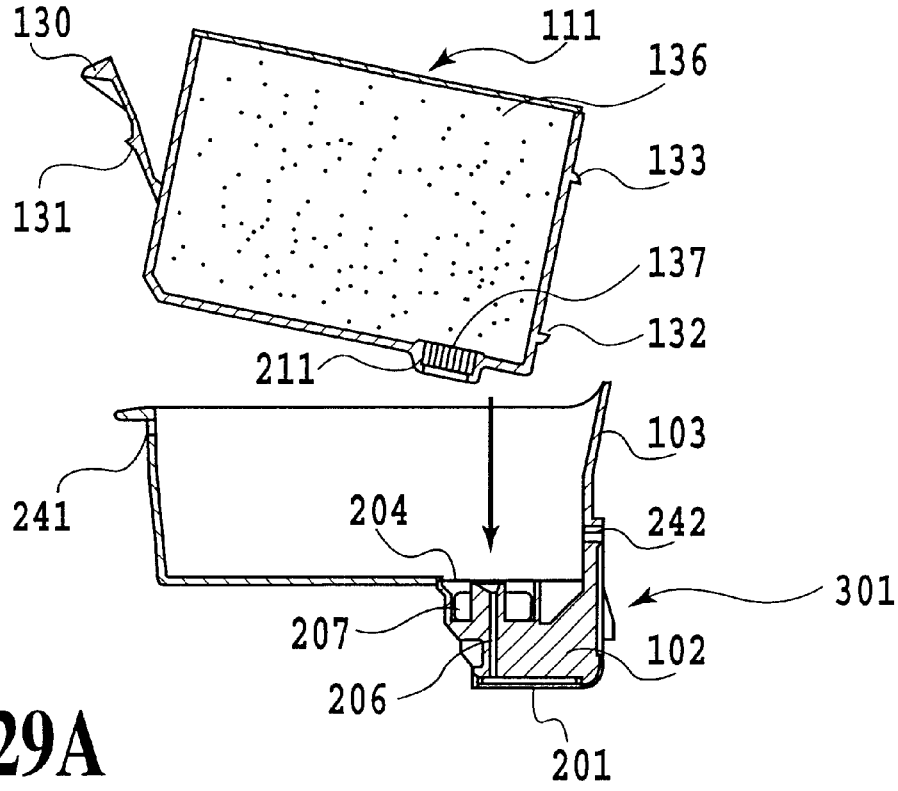
FIGS. 29A and 29B are sectional views showing the conventional print head cartridge.
Figure 29B:
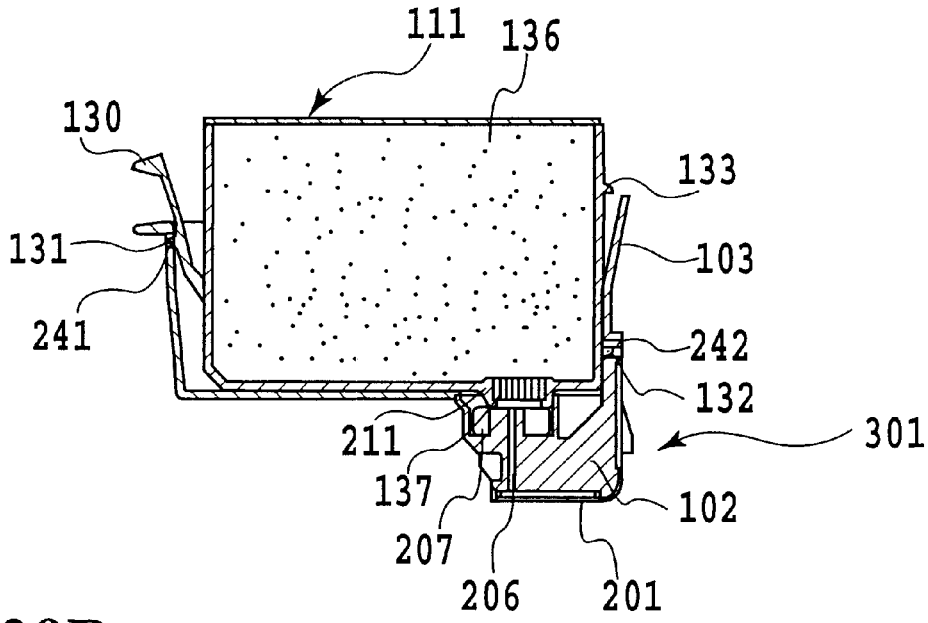

FIGS. 26 and 27 are perspective views showing a mechanism of the ejection recovery section for executing the recovery process for the above described print head cartridge H1000.

The ejection recovery section according to this embodiment comprises a recovery system unit M5000 that can be independently installed in and removed from the apparatus main body M1000. A recovery system unit M5000 comprises cleaning means for removing foreign matter attached to the print element substrate H1100 of the print head H1001, recovery means for normalizing the ink path from the ink tank H1900 to the print element substrate H1100 of the print head H1001 (that is, from the H1501 through the H1501 and H1600 to the H1400), and other means.

In FIGS. 26 and 27, reference numeral E0003 denotes a PG motor functioning as a drive source for driving a cap M5001, a pump M5100, wiper blades M5011, M5012-1, M5012-2, and an automatic feeding section M3022, which will all be described later. The PG motor E0003 provides drive forces from opposite sides of a motor shaft so that one side drives the pump M5100 or the above described automatic feeding section M3022 via a drive switching means, which will be described later, while the other side drives the cap M5001 and the wiper blades M5011, M5012-1, M5012-2, which are connected to the PG motor E0003 for synchronous movement only when the PG motor E0003 rotates in a particular rotating direction (this rotating direction will be hereafter referred to as a "normal-rotation direction", while the opposite direction will be hereafter referred to as a "reverse-rotation direction") via a one-way clutch M5041. Thus, while the PG motor E0003 is rotating in the reverse-rotation direction, the one-way clutch M5041 runs idly to prevent the drive force from being transmitted, whereby the cap M5001 and the wiper blades M5011, M5012-1, M5012-2 are not driven.

The present invention is applied to the cap M5001; that is, its rubber material is subjected to the roughened finish. The cap M5001 is attached to a cap lever M5004 that can move rotatively around a shaft. The cap M5001 is adapted to move in an arrow A direction (FIG. 12) via the one-way clutch M5041, a cap drive transmitting gear train M5110, a cap cam, and the cap lever M5004 and to abut on or separate from the print element substrate H1100 of the print head H1001. The cap M5001 has a cap absorbent M5002 located so as to be opposed to the print element substrate H1100 at a predetermined interval during capping.

The cap absorbent M5002 can receive the ink from the print head cartridge H1000 during a suction operation and completely discharge the ink from the cap M5001 to a waste ink absorbent by means of idle suction, described later. The cap M5001 has two tubes, that is, a cap tube M5009 and a valve tube M5010 connected thereto. The cap tube M5009 is connected to a pump tube M5019 of the pump M5100, described later, and the valve tube M5010 is connected to a valve rubber M5036, described later.

Moreover, reference numerals M5011, M5012-1, and M5012-2 denote the wiper blades comprising flexible members such as rubbers and each having an edge projecting perpendicularly upward from the blade holder M5013. Additionally, the blade holder M5013 has a lead screw M5031 inserted therethrough, and a projection (not shown) of the blade holder M5013 movably fitted in a groove formed in the lead screw M5031. Thus, when the blade holder M5013 rotates in synchronism with rotation of the lead screw M5031, it reciprocates along the lead screw M5031 in arrow B1 and B2 directions (FIG. 27), while the wiper blades M5011, M5012-1, M5012-2 wipe and clean the print element substrate H1100 of the print head cartridge H1000. The lead screw M5031 is connected to the PG motor E0003 via the one-way clutch M5041 and the wiper drive transmitting gear train M5120.

A reference numeral M5100 denotes a pump for using rollers (not shown) to squeeze a pump tube M5019 in order to generate a pressure therein. This pump is connected to the other side of the PG motor E0003 via the drive switching means for switching a transmission path between an automatic feeding section M3022 and the pump M5100 and via the pump drive transmitting gear train M5130. In addition, although the details are omitted, the pump M5100 has a mechanism for releasing the pressure contact force applied to the pump tube M5109 by the rollers (not shown) for squeezing the pump tube M5109. Accordingly, when the PG motor E0003 rotates in the normal-rotation direction, the pressure contact force applied by the rollers is released so as not to squeeze the tube, and when the PG motor E0003 rotates in the reverse-rotation direction, the pressure contact force applied by the rollers works to squeeze the tube. Additionally, the pump tube M5019 has one end connected to the cap M5001 via the cap tube M5009.

The drive switching means comprises a pendulum arm M5026 and a switching lever M5043. The pendulum arm M5026 is configured to move rotatively around a shaft **M5026*a* in an arrow C1 or C2 direction (FIG. 26) depending on the rotating direction of the PG motor E0003. Additionally, the switching lever M5043 is switched depending on the position of the carriage M4001. That is, when the carriage moves to above the ejection recovery system unit M5000, the switching lever M5043 partly abuts on part of the carriage M4001 and then moves in an arrow D1 or D2 direction (FIG. 26) depending on the position of the carriage M4001, thereby allowing a lock hole M5026*b* in the pendulum arm M5026 to fit over a lock pin M5043*a* of the switching lever M5043**.

On the other hand, the valve rubber M5036 has connected thereto the other end of the valve tube M5010 having one end connected to the cap M5001. In addition, the valve rubber M5036 is connected to the ejection roller M2003 (FIG. 5) via a valve cum M5035, a valve clutch M5048, and a valve drive transmitting gear train M5140, and a valve lever M5038 that can move rotatively around a shaft **M5038*a* in an arrow E1 or E2 direction depending on rotation of the ejection roller M2003 is located so as to abut on and separate from the valve rubber M5036. When the valve lever M5038 is in abutment with the valve rubber M5036, the valve is closed; when the valve lever M5038 is separate from the valve rubber M5036**, the valve is open.

Reference numeral E0010 denotes a PG sensor for detecting a position of the cap M5001.

In the described manner, similar effects are obtained by subjecting the cap of the ejection recovery section to the above-described roughened finish.

In each of the above described embodiments, the covering rubber member such as the seal rubber or the cap is integrated into the apparatus during manufacture and used to enclose the ink when the other members are installed, but the application of the present invention is not limited to this form. As is apparent from the description of the above embodiments, for example, the covering rubber member may be used to fixedly or constantly enclose the ink.

In one form where the present invention is effectively used, thermal energy generated by the electro-thermal conversion elements is used to induce film boiling in the liquid to form bubbles as described above.

As described above, according to the embodiments of the present invention, the covering rubber member and the cap rubber member have their surfaces subjected to the roughened finish ("roughened finish" means that a surface is roughened). As a result of this, when handling the covering rubber members or the like to manufacture the print head where these members are handled in a condition that they must be mutually contacted, the mutual sticking between them can be prevented due to the given surface roughness provided through the roughened finish. In particular, even if the rubber has a relatively low hardness to have more appropriate seal, the mutual sticking of the covering rubber members or the like can be prevented by appropriately setting the surface roughness.

As a result, the simple inexpensive method can be used to more easily assemble the print head or the like without degrading the sealing ability of the covering rubber member such as the seal rubber.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A print head receiving a supply of an ink from an ink tank to eject the ink, said print head comprising:

a covering rubber member used for a connection portion for ink supply between the print head and the ink tank, said covering rubber member being in contact with and covering an ink supply port of the ink tank so as to seal the ink supply port enclosing the ink and said covering member having a roughened surface, wherein a surface roughness of said roughened surface being between 5 $\mu$m and 20 $\mu$m in a term of center line mean height, wherein the covering rubber member provides a proper seal between the print head and the ink tank so as to prevent ink from leaking or from evaporating through the ink supply port.

2. A print head as claimed in claim 1, wherein said covering rubber member has the roughened surface at a part of the surface other than a part of the surface that is in contact with said ink supply port.

3. A print head as claimed in claim 1, wherein said print head uses thermal energy to generate a bubble in the ink to eject the ink by means of pressure of the bubble.

4. An inkjet printing apparatus comprising a print head and ejecting ink onto a printing medium to perform printing, wherein the print head including:

a covering rubber member used for a connection portion between the print head and an ink supply from the ink tank, said covering rubber member being in contact with and covering an ink supply port of the ink tank so as to seal the ink supply port enclosing the ink and said covering rubber member having a roughened surface, wherein a surface roughness of said roughened surface being between 5 $\mu$m and 20 $\mu$m in a term of center line mean height, wherein the covering rubber member provides a proper seal between the print head and the ink tank so as to prevent ink from leaking or from evaporating through the ink supply port.

5. An ink jet printing apparatus as claimed in claim 4, wherein the covering rubber member has the roughened surface at a part of the surface other than a part of the surface that is in contact with said ink supply port.

6. An ink jet printing apparatus as claimed in claim 4, wherein said print head uses thermal energy to generate a bubble in the ink to eject the ink by means of pressure of the bubble.

* * * * *

UNITED STATES PATENT AND TRADEMARK OFFICE

CERTIFICATE OF CORRECTION

PATENT NO. : 6,398,352 B1
DATED : June 4, 2002
INVENTOR(S) : Osamu Morita

It is certified that error appears in the above-identified patent and that said Letters Patent is hereby corrected as shown below:

Title page,
Item [56], References Cited, U.S. PATENT DOCUMENTS, "5,933,178" should read -- 5,933,173 --.

Column 9,
Line 54, "dusts" should read -- dust --.

Column 17,
Line 1, "steps" should read -- step --; and
Line 4, "any-of" should read -- any of --.

Column 18,
Line 45, "were" should read -- was --; and
Line 54, "surfaces" should read -- surface --.

Column 24,
Line 6, "a term" should read -- terms --; and
Line 29, "a term" should read -- terms --.

Signed and Sealed this

Twenty-sixth Day of November, 2002

*Attest:*

*Attesting Officer*

JAMES E. ROGAN
*Director of the United States Patent and Trademark Office*